US008687994B2

(12) United States Patent
Nakamura et al.

(10) Patent No.: US 8,687,994 B2
(45) Date of Patent: Apr. 1, 2014

(54) CARTRIDGE WITH ROLLER SHAFT HAVING AN EXPOSED ELECTROCONDUCTIVE PORTION

(75) Inventors: Yuuki Nakamura, Suntou-gun (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 12/546,136

(22) Filed: Aug. 24, 2009

(65) Prior Publication Data

US 2010/0054796 A1 Mar. 4, 2010

(30) Foreign Application Priority Data

Sep. 1, 2008 (JP) ..... 2008-223043
Jul. 7, 2009 (JP) ..... 2009-160763

(51) Int. Cl.
*G03G 15/00* (2006.01)

(52) U.S. Cl.
USPC ..... 399/90; 399/89; 399/111; 399/113; 399/117; 399/167

(58) Field of Classification Search
USPC ..... 399/111, 113, 117, 167, 89, 90
See application file for complete search history.

(56) References Cited

U.S. PATENT DOCUMENTS 6,072,968 A * 6/2000 Nomura et al. ..... 399/113
6,385,416 B1 5/2002 Horikawa et al. ..... 399/111
6,473,578 B2 * 10/2002 Miyabe et al. ..... 399/90
6,508,601 B1 * 1/2003 Lui et al. ..... 399/111
6,608,980 B2 8/2003 Murayama et al. ..... 399/111
6,714,752 B2 3/2004 Ueno et al. ..... 399/117
6,823,153 B2 11/2004 Ueno et al. ..... 399/103
6,829,455 B2 12/2004 Yasumoto et al. ..... 399/167
6,834,175 B2 12/2004 Murayama et al. ..... 399/256
6,898,391 B2 5/2005 Numagami et al. ..... 399/90
6,912,365 B2 6/2005 Ueno et al. ..... 399/25
6,954,600 B2 10/2005 Fujita et al. ..... 399/89
6,954,601 B2 10/2005 Numagami et al. ..... 399/90
6,968,146 B1 11/2005 Fujita et al. ..... 399/258
6,970,668 B2 11/2005 Ueno et al. ..... 399/109
6,978,099 B2 12/2005 Ueno et al. ..... 399/103
7,003,247 B2 2/2006 Koishi et al. ..... 399/167
7,062,200 B2 6/2006 Ueno et al. ..... 399/111
7,092,658 B2 8/2006 Yasumoto et al. ..... 399/167

(Continued)

FOREIGN PATENT DOCUMENTS

JP 2004-126030 4/2004
JP 2005-250107 9/2005
JP 2005-258145 9/2005

OTHER PUBLICATIONS

English Translation of JP2005250107 to Yamashita, Sep. 2005.*

*Primary Examiner* — Ryan Walsh
(74) *Attorney, Agent, or Firm* — Fitzpatrick, Cella, Harper & Scinto

(57) ABSTRACT

A cartridge detachably mountable to a main assembly of an image forming apparatus, the main assembly including a main assembly electrical contact, includes a roller including an electroconductive shaft, the roller being rotatable with the shaft; and a supporting member rotatably supporting the shaft and provided with a hole portion for exposing a part of a surface of a longitudinal end of the shaft to directly contact the part to the main assembly electrical contact and an end surface positioning portion for determining a position of the end surface with respect to a longitudinal direction of the shaft by contacting another part of the end surface.

21 Claims, 21 Drawing Sheets

(56) References Cited

U.S. PATENT DOCUMENTS

| | | | | |
|---|---|---|---|---|
| 7,139,502 | B2 | 11/2006 | Koishi et al. | 399/93 |
| 7,158,749 | B2 | 1/2007 | Ueno et al. | 399/351 |
| 7,164,875 | B2 | 1/2007 | Miyabe et al. | 399/111 |
| 7,174,122 | B2 | 2/2007 | Fujita et al. | 399/258 |
| 7,184,690 | B2 | 2/2007 | Ueno et al. | 399/117 |
| 7,209,682 | B2 | 4/2007 | Numagami et al. | 399/167 |
| 7,248,810 | B2 | 7/2007 | Miyabe et al. | 399/90 |
| 7,315,710 | B2 | 1/2008 | Ueno et al. | 399/117 |
| 7,366,452 | B2 | 4/2008 | Fujita et al. | 399/258 |
| 7,440,715 | B2 | 10/2008 | Numagami et al. | 399/167 |
| 7,450,877 | B2 | 11/2008 | Miyabe et al. | 399/90 |
| 7,457,566 | B2 | 11/2008 | Koishi et al. | 399/167 |
| 7,483,646 | B2 | 1/2009 | Ueno et al. | 399/102 |
| 2003/0142991 | A1* | 7/2003 | Arimitsu et al. | 399/111 |
| 2005/0220476 | A1* | 10/2005 | Kakitani et al. | 399/111 |
| 2006/0198654 | A1* | 9/2006 | Noda et al. | 399/111 |
| 2006/0269318 | A1 | 11/2006 | Ueno et al. | 399/106 |
| 2008/0152388 | A1 | 6/2008 | Ueno et al. | 399/167 |
| 2008/0260428 | A1 | 10/2008 | Ueno et al. | 399/167 |
| 2008/0286000 | A1 | 11/2008 | Kimizuka et al. | 399/111 |
| 2008/0292331 | A1 | 11/2008 | Yokomori et al. | 399/27 |
| 2009/0047037 | A1 | 2/2009 | Miyabe et al. | 399/111 |
| 2009/0092411 | A1 | 4/2009 | Ueno et al. | 399/105 |
| 2009/0226206 | A1 | 9/2009 | Ueno et al. | 399/103 |

* cited by examiner

CARTRIDGE WITH ROLLER SHAFT HAVING AN EXPOSED ELECTROCONDUCTIVE PORTION

FIELD OF THE INVENTION AND RELATED ART

The present invention relates to a process cartridge removably mountable in the main assembly of an electrophotographic image forming apparatus.

In the field of an electrophotographic image forming apparatus, it is common practice to employ a cartridge system, which integrally places an electrophotographic photosensitive member, and one or more means for processing the electrophotographic photosensitive member, in a cartridge, so that the electrophotographic photosensitive member and processing means can be removably mountable in the main assembly of an electrophotographic image forming apparatus.

A cartridge system makes it possible for users to maintain an electrophotographic image forming apparatus by themselves, that is, without relying on a service person. Thus, the employment of a cartridge system can drastically improve an electrophotographic image forming apparatus in terms of operational efficiency. This is why a cartridge system has come to be widely used in the field of electrophotographic image forming apparatus.

A process cartridge has rotational rollers, such as a charge roller for uniformly charging the peripheral surface of a photosensitive member, and a development roller for developing an electrostatic latent image formed on the photosensitive member. A process cartridge has also input electrical contacts, which are connected to the electrical contacts, with which the main assembly of an electrophotographic image forming apparatus is provided. The input electrical contacts are in connection with the abovementioned rollers. Thus, as a process cartridge is mounted into the main assembly of the image forming apparatus, electrical connection is made between the process cartridge and main assembly, enabling the rollers to be supplied with the electric voltage from the main assembly.

For example, in the case of the image forming apparatus structure disclosed in Japanese Laid-open Patent Application 2004-126030, the input electrical contacts, which are to be in contact with the rotational rollers, are solidly attached to the cartridge. Thus, it becomes possible for voltages to be supplied from the main assembly of the image forming apparatus to the cartridge, by placing these input electrical contacts in contact with the electrical contacts, with which the main assembly of the image forming apparatus are provided.

Further, in the case of the image forming apparatus structure disclosed in Japanese Laid-open Patent Application 2005-258145, the cartridge is provided with guiding portions for guiding the electrical contacts, which the main assembly of the image forming apparatus has, to the input electrical contacts, which the cartridge has.

In the case of the conventional technologies described above, it is made possible to reliably supply a cartridge with the voltages from the main assembly of an image forming apparatus, by connecting the electrical contacts solidly attached to the cartridge so that they remain in contact with the rollers in the cartridge even when the rollers are rotating, with the electrical contacts which the main assembly has.

SUMMARY OF INVENTION

The object of the present invention is to simplify an electrophotographic image forming apparatus in structure, and also, to reduce an electrophotographic image forming apparatus in cost, by reducing the number of components related to the electrical connection between the main assembly of the image forming apparatus and the cartridges therefor, without interfering with the reliable supply of voltage from the main assembly of the image forming apparatus to the cartridge.

According to an aspect of the present invention, there is provided a cartridge detachably mountable to a main assembly of an image forming apparatus, the main assembly including a main assembly electrical contact, said cartridge comprising a roller including an electroconductive shaft, said roller being rotatable with said shaft; and a supporting member rotatably supporting said shaft and provided with a hole portion for exposing a part of a surface of a longitudinal end of said shaft to directly contact the part to the main assembly electrical contact and an end surface positioning portion for determining a position of the end surface with respect to a longitudinal direction of said shaft by contacting another part of said end surface.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

Hereinafter, the cartridge in this embodiment of the present invention, which is removably mountable in the main assembly of an electrophotographic image forming apparatus, will be described along with the main assembly, in which the cartridge is removably mountable, with reference to the appended drawings.

Here, a "cartridge" means a development cartridge for developing an electrostatic latent image on an electrophotographic photosensitive member. It includes a process cartridge, that is, a cartridge which has an electrophotographic photosensitive member as well as processing means, such as a developing means, for processing the electrophotographic photosensitive member. These cartridges are removably mounted in the main assembly of an electrophotographic image forming apparatus by a user.

Further, an "electrophotographic image forming apparatus" means an apparatus which forms an image on recording medium with the use of an electrophotographic image forming method. As examples of an electrophotographic image forming apparatus, an electrophotographic copying machine, an electrophotographic printer (LED printer, a laser beam printer, etc.), a facsimile apparatus, a word processor, etc., can be included.

The abovementioned "recording medium" means a sheet of medium, on which an image can be formed. It includes a sheet of paper, an OHP sheet, etc.

Further, the "main assembly" of an electrophotographic image forming apparatus means what remains after the removal of a cartridge (cartridges) from an electrophotographic image forming apparatus.

[Embodiment 1]

Hereafter, referring to FIGS. 1-18, the development cartridge, in this embodiment, which is removably mountable in the main assembly of an electrophotographic image forming apparatus, will be described.

(Overall Structure of Electrophotographic Image Forming Apparatus)

Figure 5:
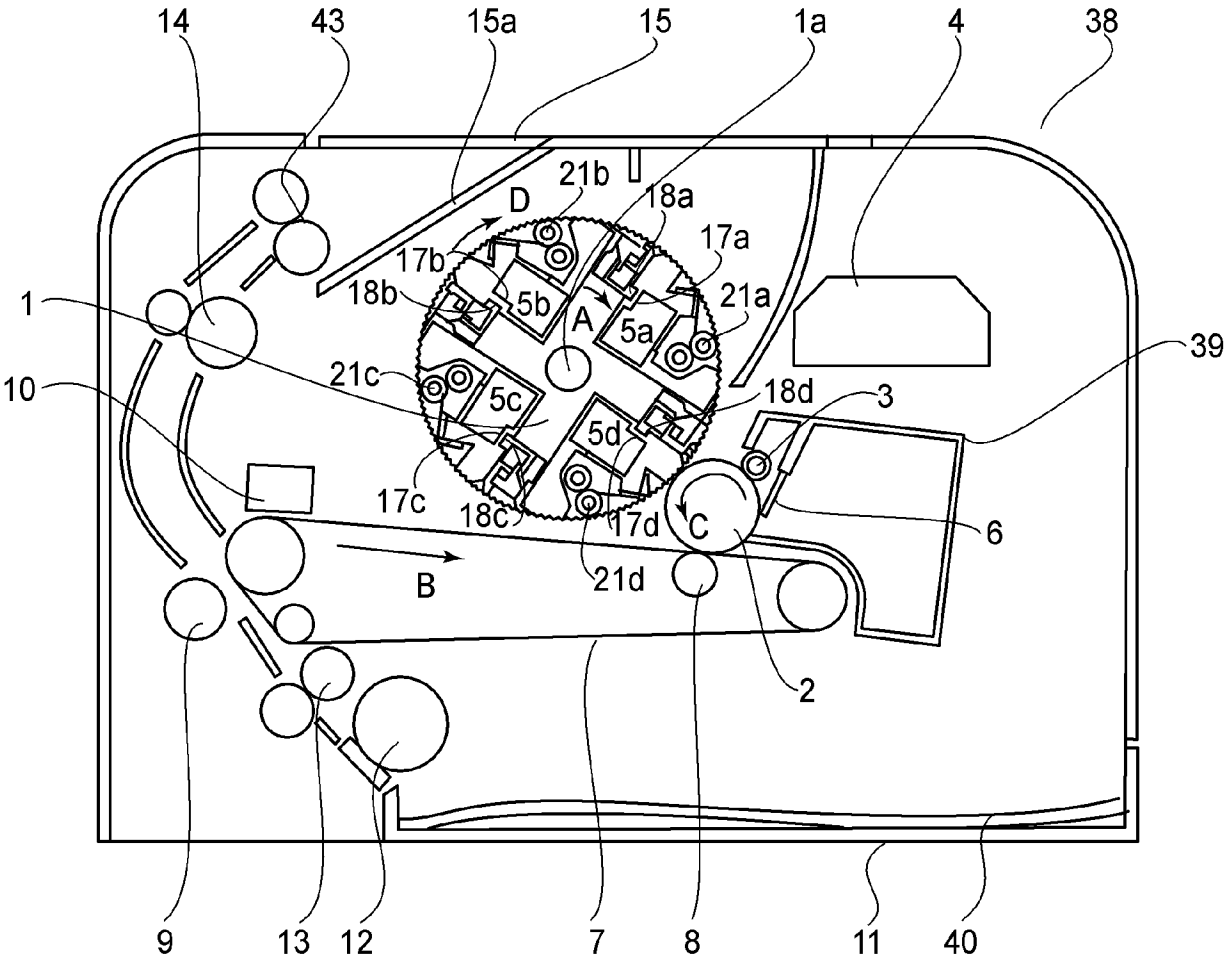
FIG. 5 is a sectional view of the main assembly, development cartridge, and process cartridge of the image forming apparatus.
Figure 6:
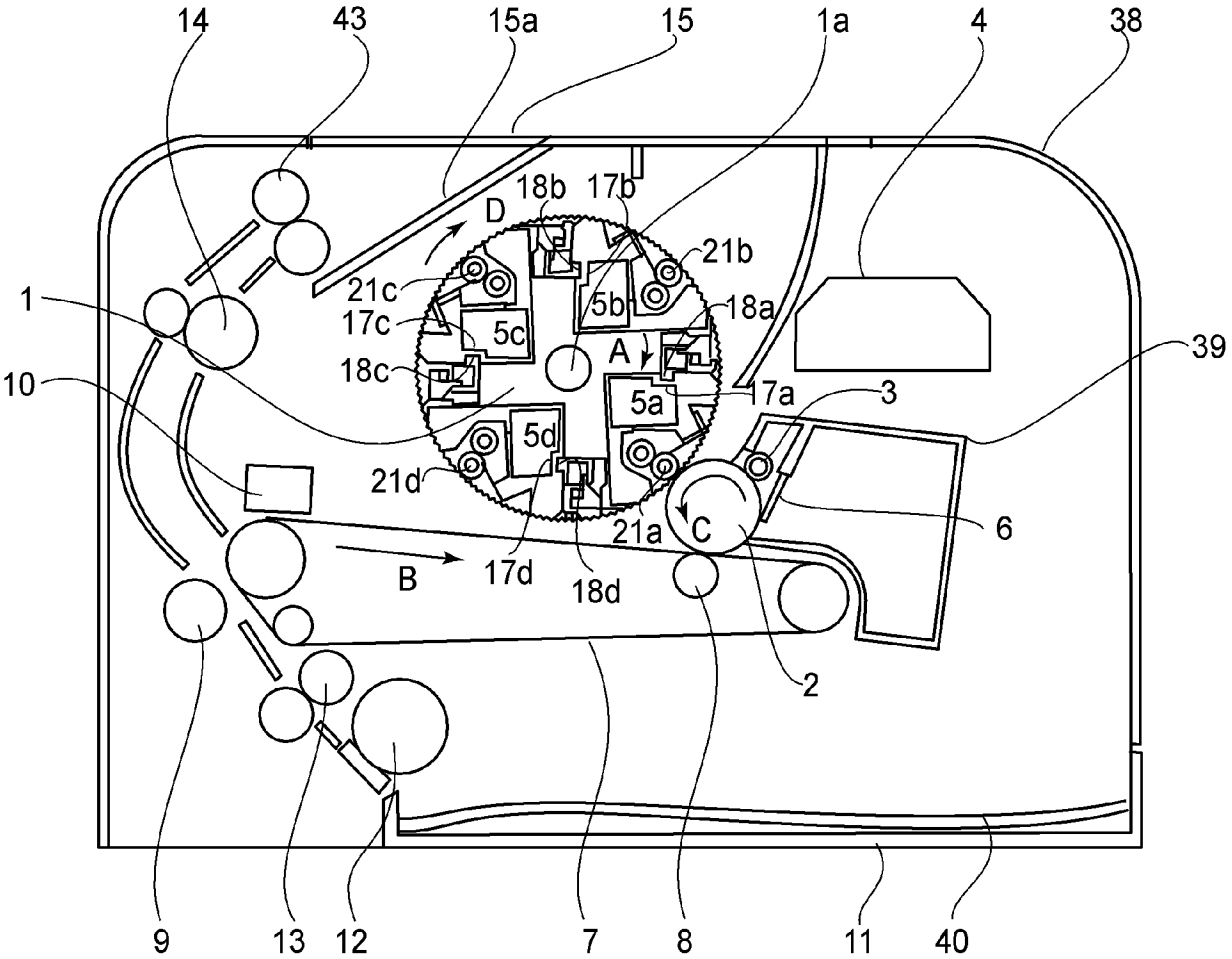
FIG. 6 is a sectional view of the main assembly, development cartridge, and process cartridge of the image forming apparatus.
Figure 7:
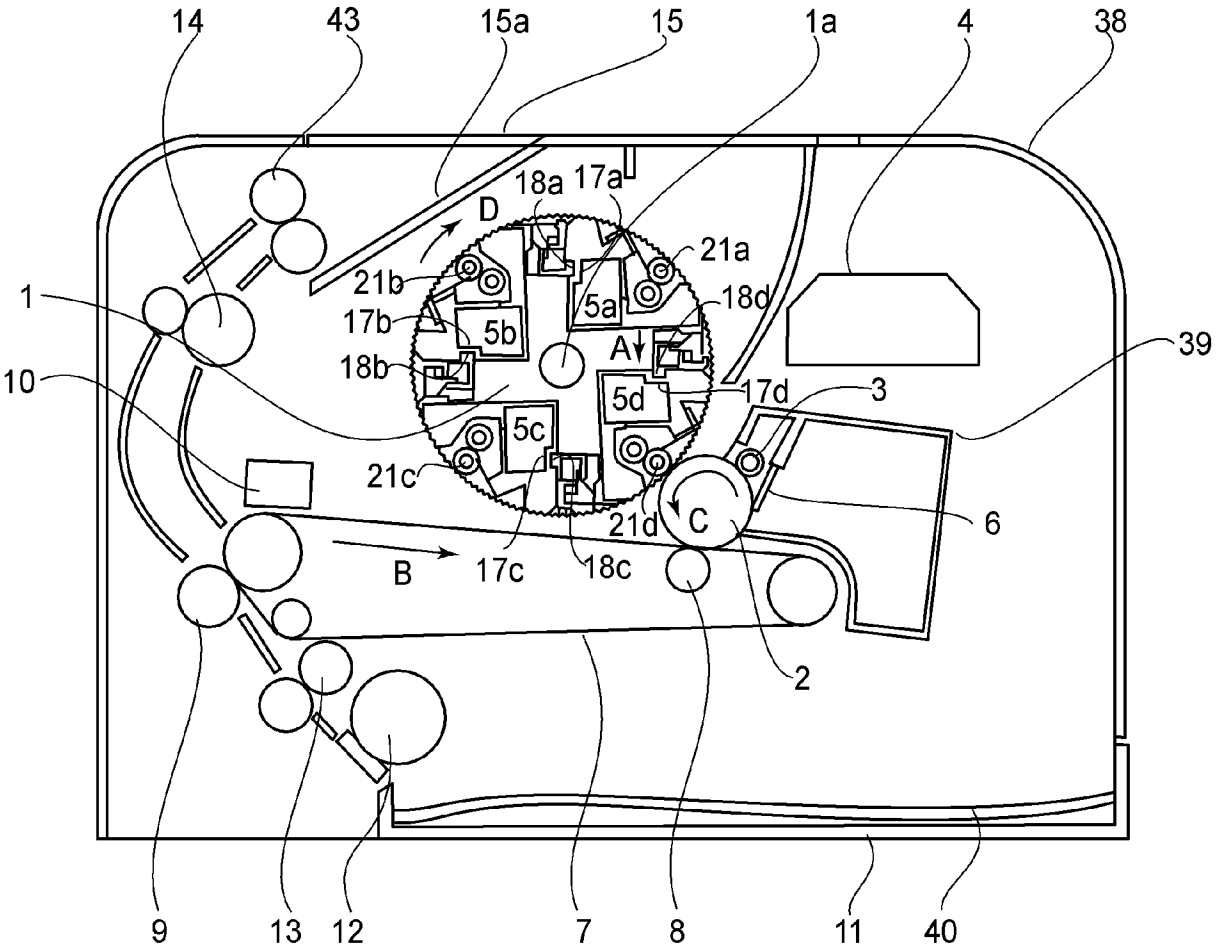
FIG. 7 is a sectional view of the main assembly, development cartridge, and process cartridge of the image forming apparatus.

First, referring to FIGS. 5, 6, and 7, the overall structure and image forming operation of the electrophotographic image forming apparatus (which hereafter will be referred to simply as image forming apparatus) in this embodiment will be described. FIGS. 5, 6, and 7 are sectional views of the combination of the main assembly 38 of the image forming apparatus (which hereafter may be referred to as apparatus main assembly 38), development cartridge 5, and process cartridge 39.

The image forming apparatus shown in FIG. 5 is a full-color laser beam printer, which is based on four primary colors, and, the main assembly 38 of which is structured so that four development cartridges 5 (5*a*, 5*b*, 5*c*, and 5*d*) and one process cartridge 39 are removably mountable in the main assembly 38. FIG. 5 shows the image forming apparatus after the proper mounting of the process cartridge 39 and development cartridges 5 into the apparatus main assembly 38. The image forming apparatus has an exposing means (laser scanner unit) 4, which is on the top side of the process cartridge 39. Disposed on the bottom side of the cartridges 39 and 5 is a sheet feeder cassette 11 in which sheets of recording medium (which hereafter may be referred to simply as sheets) are stored. Further, the apparatus main assembly 38 is provided with a feed roller 12, a pair of conveyance rollers 13, a secondary transfer roller 9, a fixing device 14, a pair of discharge rollers 43, a delivery area 15*a*, etc., which are positioned in the listed order, starting from the upstream side in terms of the direction in which the sheet 40 is conveyed. Incidentally, the feed roller 12, conveyance rollers 13, discharge rollers, 43 etc., make up the conveying means for conveying the sheet 40. An intermediary transfer belt 7 is an intermediary transferring member for temporarily bearing and conveying the developer image formed on an electrophotographic photosensitive drum 2, as an image bearing member, (which hereafter will be referred to simply as photosensitive drum). Further, a primary transfer roller 8 is a transfer roller for transferring (primary transfer) the developer image formed on the photosensitive drum 2, onto the intermediary transfer belt 7. A cleaning unit 10 is a unit for removing the developer (which hereafter may be referred to as toner) remaining on the intermediary transfer belt 7 after the primary transfer.

The process cartridge 39 is a process cartridge made by integrally placing the photosensitive drum 2 and the photosensitive drum processing means, more specifically, a charging means 3 and a cleaning means 6, in a cartridge. It is removably mountable in the apparatus main assembly 38. The charging means 3 is for uniformly charging the photosensitive drum 2. The cleaning means 6 is for removing the toner remaining on the photosensitive drum 2 after the primary transfer. Incidentally, the photosensitive drum 2, charging means 3, and cleaning means 3 may be independently placed in their own cartridges.

The development cartridge 5 is a developing apparatus (developing means) for developing an electrostatic latent image formed on the photosensitive drum 2, into a visible image with the use of color toners, the color of which corresponds to the monochromatic components of a color image, one for one. The image forming apparatus in this embodiment employs four development cartridges, more specifically, a yellow development cartridge 5*a*, a magenta development cartridge 5*b*, a cyan development cartridge 5*c*, and a black development cartridge 5*d*, as described above. The yellow development cartridge 5*a*, magenta development cartridge 5*b*, cyan development cartridge 5*c*, and black development cartridge 5*d* are held by a rotary 1 attached to the apparatus main assembly 38 so that it is rotatable about its rotational shaft 1*a*. The yellow development cartridge 5*a*, magenta development cartridge 5*b*, cyan development cartridge 5*c*, and black development cartridge 5*d* are removably mounted in the rotary 1. Each development cartridge has: a development roller 21 for developing the electrostatic latent image formed on the photosensitive drum 2; and a toner supply roller 22 (developer supply roller) for supplying the development roller 21 with toner, as will be described later in detail. Referring to FIG. 5, the yellow development cartridge 5*a* has a development roller 21*a* and a toner supply roller 22*a*. The magenta development cartridge 5*b* has a development roller 21*b* and a toner supply roller 22*b*. The cyan development cartridge 5*c* has a development roller 21*c* and a toner supply roller 22*c*. The black development cartridge 5*d* has a development roller 21*d* and a toner supply roller 22*d*.

The structural arrangements for the rotary 1 to support the yellow, magenta, cyan, and black development cartridges 5*a*, 5*b*, 5*c*, and 5*d*, respectively, are the same. Thus, the structural arrangements will be described with reference to the structural arrangement for the rotary 1 to support the yellow development cartridge 5*a*.

As the yellow development cartridge 5*a* is mounted into the rotary 1, the rotary engaging portion 17*a* of the yellow development cartridge 5*a* engages with the development cartridge engaging member 18*a*, with which the rotary 1 is provided, being thereby prevented from popping out of the rotary 1. The development cartridge engaging member 18*a* is under the pressure generated by a spring (unshown) in the direction indicated by an arrow mark A in FIG. 5, that is, the direction in which it should be pressed to be engaged with the cartridge 5*a*. The other cartridges 5*b*, 5*c*, and 5*d* are also in engagement with the development cartridge engaging members 18*b*, 18*c*, and 18*d*, respectively, with which the rotary 1 is provided, being thereby prevented from popping out of the rotary 1.

First, the photosensitive drum 2 is rotated in the direction indicated by an arrow mark C in FIG. 5, and the intermediary transfer belt 7 is rotated in the direction indicated by an arrow mark B in synchronism with the rotation of the photosensitive drum 2. As the photosensitive drum 2 is rotated, the peripheral surface of the photosensitive drum 2 is uniformly charged by the charging means 3. Then, the charged portion of the peripheral surface of the photosensitive drum 2 is scanned with a beam of laser light projected by the exposing means 4, while being modulated with the information regarding the monochromatic yellow component of the image to be formed. As a result, the electrostatic latent image corresponding to the yellow component of the image to be formed is effected on the photosensitive drum 2.

At the same time as the formation of this electrostatic latent image, the rotary 1, which is holding the development cartridges 5*a*, 5*b*, 5*c*, and 5*d*, is rotated about its rotational shaft 1*a* by the driving force transmitting mechanism of the main assembly 38, in the direction indicated by an arrow mark D in FIG. 5, so that the yellow development cartridge 5*a* is positioned in the development position (FIG. 6), in which it opposes the photosensitive drum 2 (as shown in FIG. 6).

Then, a difference in potential level is provided between the photosensitive drum 2 and development roller 21*a* to make the yellow toner adhere to the latent image formed on the photosensitive drum 2. As a result, the yellow toner is adhered to the latent image on the photosensitive drum 2; the latent image is developed. That is, a visible image is formed of the yellow toner on the photosensitive drum 2. Hereafter, the toner image formed of the yellow toner will be referred to as yellow toner image.

Thereafter, the yellow toner image on the photosensitive drum 2 is transferred (primary transfer) onto the intermediary transfer belt 7 by applying a voltage, which is opposite in polarity to the toner, to the primary transfer roller 8, which is on the inward side of the loop which the intermediary transfer belt 7 forms.

As the primary transfer of the yellow toner image is completed as described above, the rotary 1 rotates in the direction indicated by the arrow mark D in FIG. 6, by being driven by the driving force transmitting mechanism of the apparatus main assembly 38; the magenta, cyan, and black development cartridges 5*b*, 5*c*, and 5*d*, respectively, are sequentially placed in the development position, in which each development cartridge opposes the photosensitive drum 2, so that the electrostatic latent image formation process, development process, and primary transfer process are sequentially carried out to sequentially form monochromatic magenta, cyan, and black toner images on the intermediary transfer belt 7. As a result, four monochromatic toner images, different in color, are placed in layers on the intermediary transfer belt 7.

Next, referring to FIGS. 5 and 6, while the above described processes are carried out, the secondary transfer roller 9 remains separated from the intermediary transfer belt 7, and so does the cleaning unit 10 for cleaning the intermediary transfer belt 7.

Meanwhile, the sheets 40 stored in layers in the sheet feeder cassette 11 are fed one by one into the apparatus main assembly 38 while being separated from the rest, and conveyed toward the conveyance rollers 13. As each sheet 40 reaches the conveyance rollers 13, the conveyance rollers 13 send the sheet 40 to the interface between the intermediary transfer belt 7 and secondary transfer roller 9. Incidentally, the secondary transfer roller 9 is kept pressed upon the intermediary transfer belt 7, as shown in FIG. 7.

To the secondary transfer roller 9, a voltage which is opposite in polarity to the toner is being applied. Thus, the four layers of monochromatic toner images, different in color, on the intermediary transfer belt 7 are transferred (secondary transfer) onto the surface of the sheet 40 as the sheet 40 is conveyed through the interface between the secondary transfer roller 9 and intermediary transfer belt 7.

After the transfer of the toner images onto the sheet 40, the sheet 40 is sent to the fixing device 14. In the fixing device 14, the sheet 40 and the toner images thereon are subjected to heat and pressure. As a result, the toner images are fixed to the sheet 40; a multicolor (full-color) image is formed on the sheet 40. Thereafter, the sheet 40 is discharged by the pair of discharge rollers 43 into the delivery portion 15*a*, which is a part of the top portion of the external shell of the apparatus main assembly 38.

(Description of Development Cartridge)

The yellow, magenta, cyan, and black development cartridges 5*a*, 5*b*, 5*c*, and 5*d*, respectively, are the same in structure. Thus, the structure of the yellow development cartridge 5*a* will be described as an example of the development cartridge structure. Next, referring to FIGS. 3-8, the development cartridge structure will be described.

Figure 4:
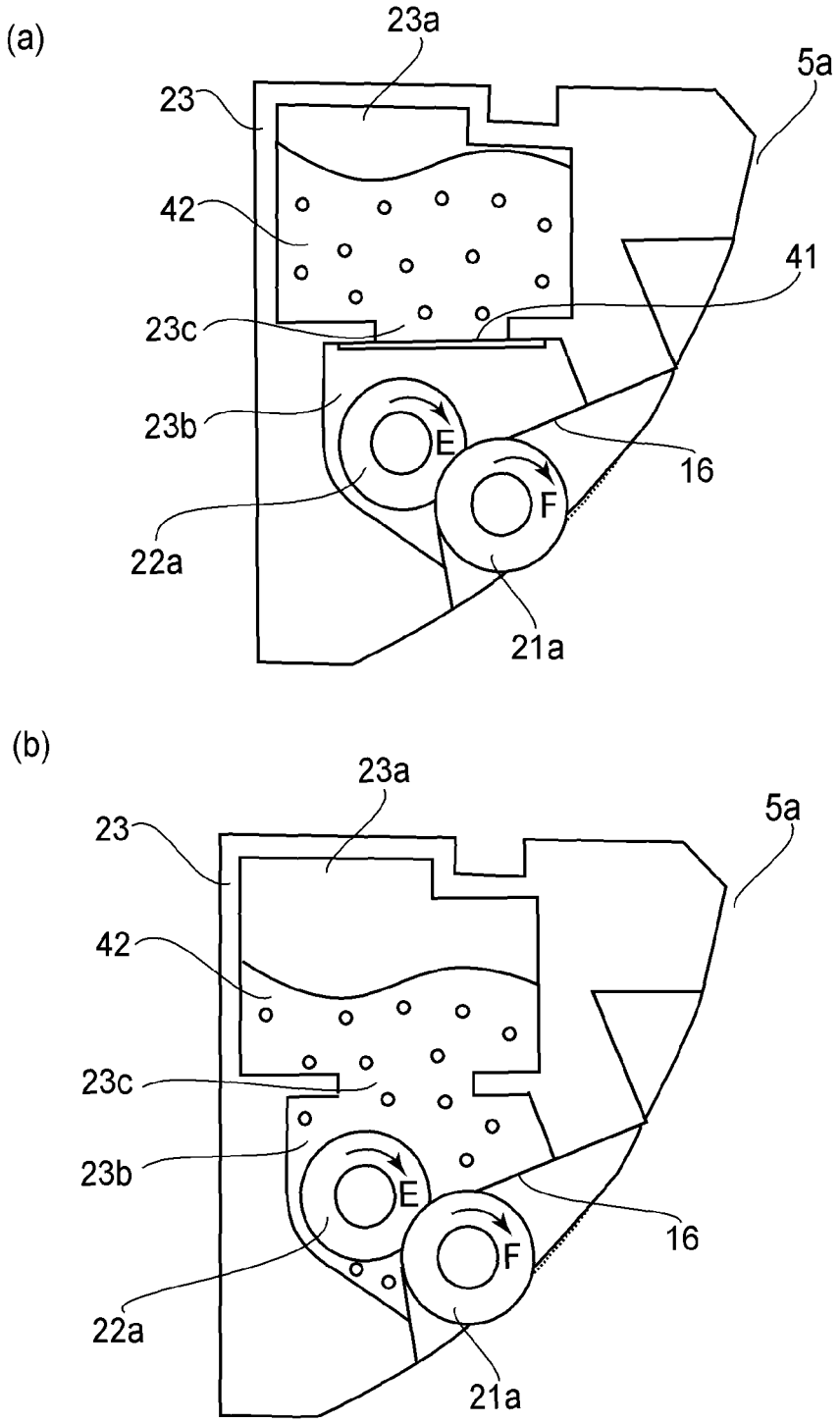
FIGS. 4(*a*) and 4(*b*) are sectional views of the development cartridge.
Figure 8:
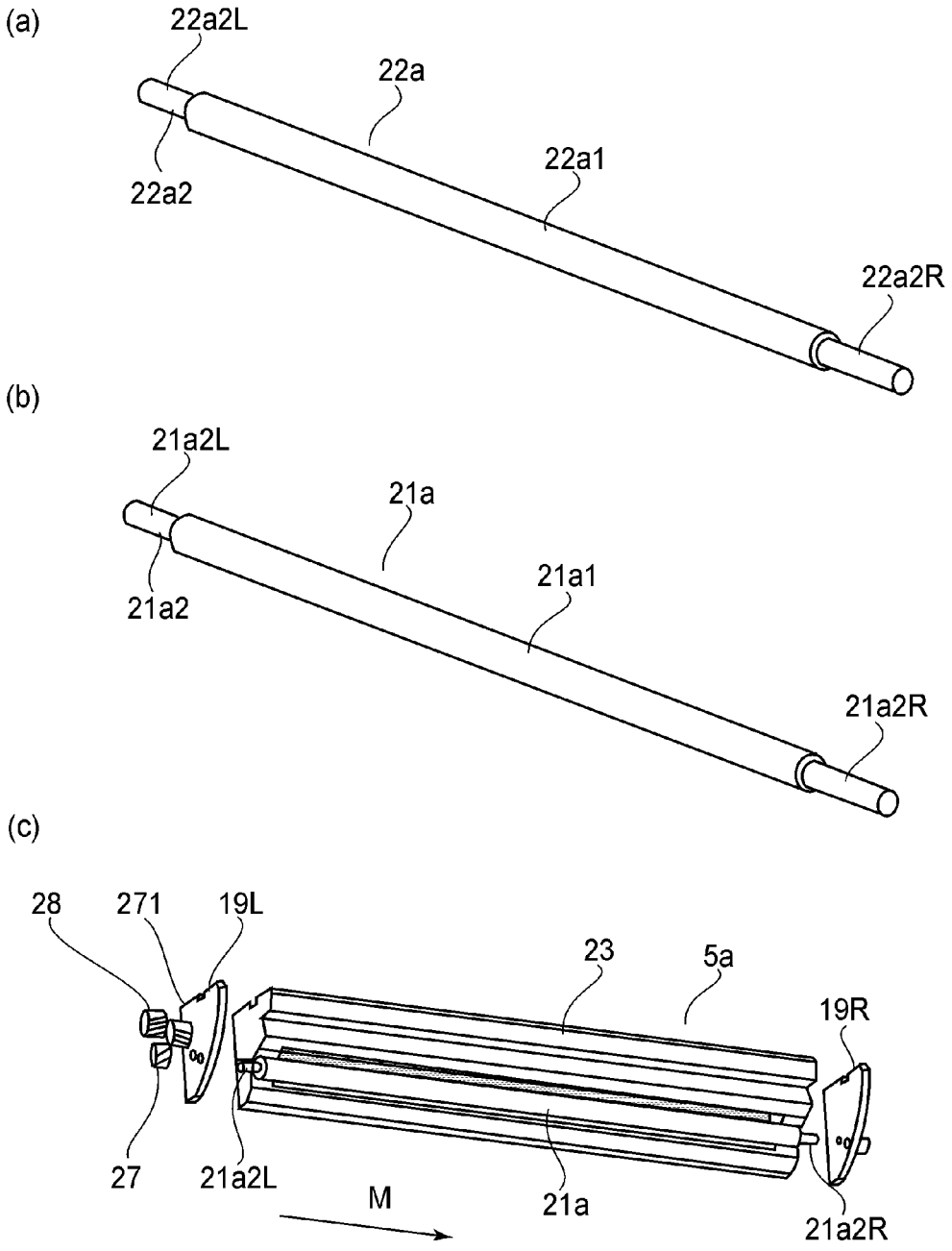
FIGS. 8(*a*) and 8(*b*) are perspective views of the toner supply roller and development roller, respectively, and FIG. 8(*c*) is an exploded perspective view of the development cartridge, which shows the structure thereof.

FIGS. 4(*a*) and 4(*b*) are sectional views of the yellow development cartridge 5*a*. FIGS. 8(*a*) and 8(*b*) are perspective views of the toner supply roller and development roller, respectively. FIG. 8(*c*) is a partially exploded view of the development cartridge, which is for describing the development roller supporting structure of the cartridge.

The developing means container 23, which is the framework of the yellow development cartridge 5*a*, has a toner storage chamber 23*a* and a development chamber 23*b*. The development chamber 23*b* has the development roller 21*a* and toner supply roller 22*a*. The toner chamber 23*a* is on top of the development chamber 23*b*. The two chambers 23*a* and 23*b* are separated by a toner delivery opening 23*c*. Until the yellow development cartridge 5*a* reaches a user, more specifically, until it is used for the first time, the toner delivery opening 23*c* remains sealed with a toner seal 41, which is a piece of film attached between the toner storage chamber 23*a* and development chamber 23*b* to keep the two chambers 23*a* and 23*b* separated from each other; the toner seal 41 is tightly attached to the developing means container 23 by thermal welding or the like method in a manner to block the toner delivery opening 23*c*. The toner seal 41 is to be removed before the yellow development cartridge 5*a* is used for the first time. As the toner seal 41 is removed, the toner 42 in the toner storage chamber 23*a* naturally falls into the adjacencies of the development position, shown in FIG. 6, where the development roller 21*a* opposes the photosensitive drum 2, as shown in FIG. 4(*b*).

The toner supply roller 22*a* is the roller for supplying the development roller 21*a* with the toner, and is made up of a sponge roller portion 22*a*1, and an electrically conductive shaft 22*a*2, as shown in FIG. 8(*a*). The toner supply roller 22*a* is structured so that the sponge roller portion 22*a*1 rotates with the shaft 22*a*2. In this embodiment, a shaft which is made of free-cutting steel (SUM24L), and is KN-plated, is used as the shaft 22*a*2. The shaft 22*a*2 is put through the sponge roller portion 22*a*1 in the direction parallel to the lengthwise direction of the rotational axis of the toner supply roller 22*a*, in such a manner that its lengthwise ends 22*a*2L and 22*a*2R extend from the left and right lengthwise ends of the sponge roller portion 22*a*1, respectively.

The development roller 21*a* is the roller for developing an electrostatic latent image formed on the photosensitive drum 2. It is made up of a rubber roller portion 21*a* 1 and an electrically conductive shaft 21*a*2, as shown in FIG. 8(*b*). The development roller 21*a* is structured so that the rubber roller portion 21*a* 1 rotates with the shaft 21*a*2. The shaft 21*a*2 is put through the rubber roller portion 21*a* 1 in the direction parallel to the lengthwise direction of the rotational axis of the development roller 21*a*, in such a manner that its lengthwise ends 21*a*2L and 21*a*2R extend from the left and right lengthwise ends of the rubber roller portion 21*a* 1, respectively.

The structural arrangement for the yellow development cartridge 5*a* to support the toner supply roller 22*a*, and the structural arrangement for the yellow development cartridge 5*a* to support the development roller 21*a*, are the identical. Thus, the structural arrangement for the yellow development cartridge 5*a* to support the development roller 21*a* is described as an example of the structural arrangement for which the yellow development cartridge 5*a* to support its rollers. Referring to FIG. 8(*c*), the yellow development cartridge 5*a* is rotatably supported; the lengthwise end portions 21*a*2L and 21*a*2R are rotatably supported by a pair of supporting members 19L and 19R, respectively.

The toner 42 in the development chamber 23*b* is picked up by the toner supply roller 22*a*. Then, as the toner supply roller 22*a* is rotated in the direction indicated by an arrow mark E in FIG. 4(*b*), it supplies the development roller 21*a* with the toner 42. The development roller 21*a* is rotated in the direction indicated by an arrow mark F in FIG. 4(*b*). As the development roller 21*a* is rotated in the direction F, the toner 42 on the development roller 21 is regulated by a development blade 16, and then, is transferred onto the photosensitive drum 2; the latent image on the photosensitive drum 2 is developed by the toner 42 from the development roller 21*a*. After the development, the toner 42 remaining on the development roller 21*a* is removed by the toner supply roller 22*a*. Then, the development roller 21*a* is supplied again with the toner 42 by the toner supply roller 22*a*. In order to develop the latent image on the photosensitive drum 2, the development roller 21*a* is supplied with the voltage from the apparatus main assembly 38. Further, the toner supply roller 22*a* is also supplied with the voltage from the apparatus main assembly 38.

In order to ensure that the state of contact between the development roller 21*a* and photosensitive drum 2 in the development position remains stable, the rotary 1, by which the yellow development cartridge 5*a* is held, is kept pressed toward the photosensitive drum 2. Thus, the development roller 21*a* of the yellow development cartridge 5*a* is kept pressed upon the photosensitive drum 2 in such a manner that a preset amount of contact pressure is maintained between the development roller 21*a* and photosensitive drum 2.

(Method for Mounting Development Cartridge into Image Forming Apparatus Main Assembly, and Method for Removing Development Cartridge from Image Forming Apparatus Main Assembly)

Next, referring to FIG. 9, the operation for mounting the yellow, magenta, cyan, and black development cartridges 5*a*, 5*b*, 5*c*, and 5*d*, respectively, into the apparatus main assembly 38, and the operation for removing them from the apparatus main assembly 38, will be described.

Figure 9:
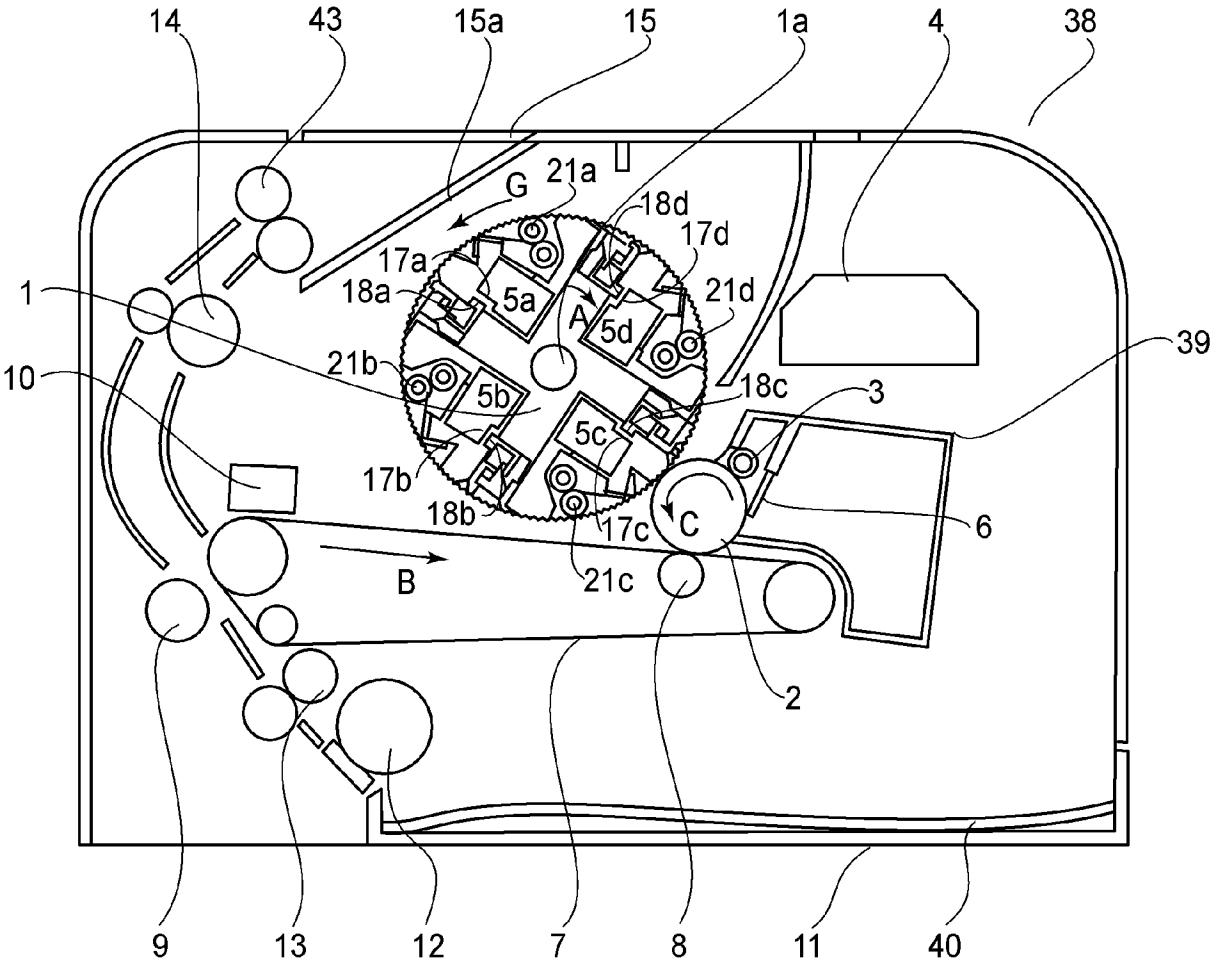
FIG. 9 is a sectional view of the electrophotographic image forming apparatus, and shows the general structure of the apparatus.

Referring to FIG. 9, except during a development operation, the rotary 1 is kept on standby in one of the preset positions, into which it is rotated to keep the development roller 21 separated from the photosensitive drum 2. For example, the position in which the black development cartridge 5*d* is kept on standby, is 40° away in the direction indicated by an arrow mark G in FIG. 9 from the development position. As for the movement of each development cartridge into its standby position, each development cartridge is automatically moved into its standby position by the driving force transmitting mechanism after the completion of the formation of a monochromatic image for which each development cartridge is used. The position, shown in FIG. 9, in which the black development cartridge 5*d* is kept on standby, is the development cartridge position, into which each development cartridge is mounted, or from which each development cartridge is removed.

Figure 10:
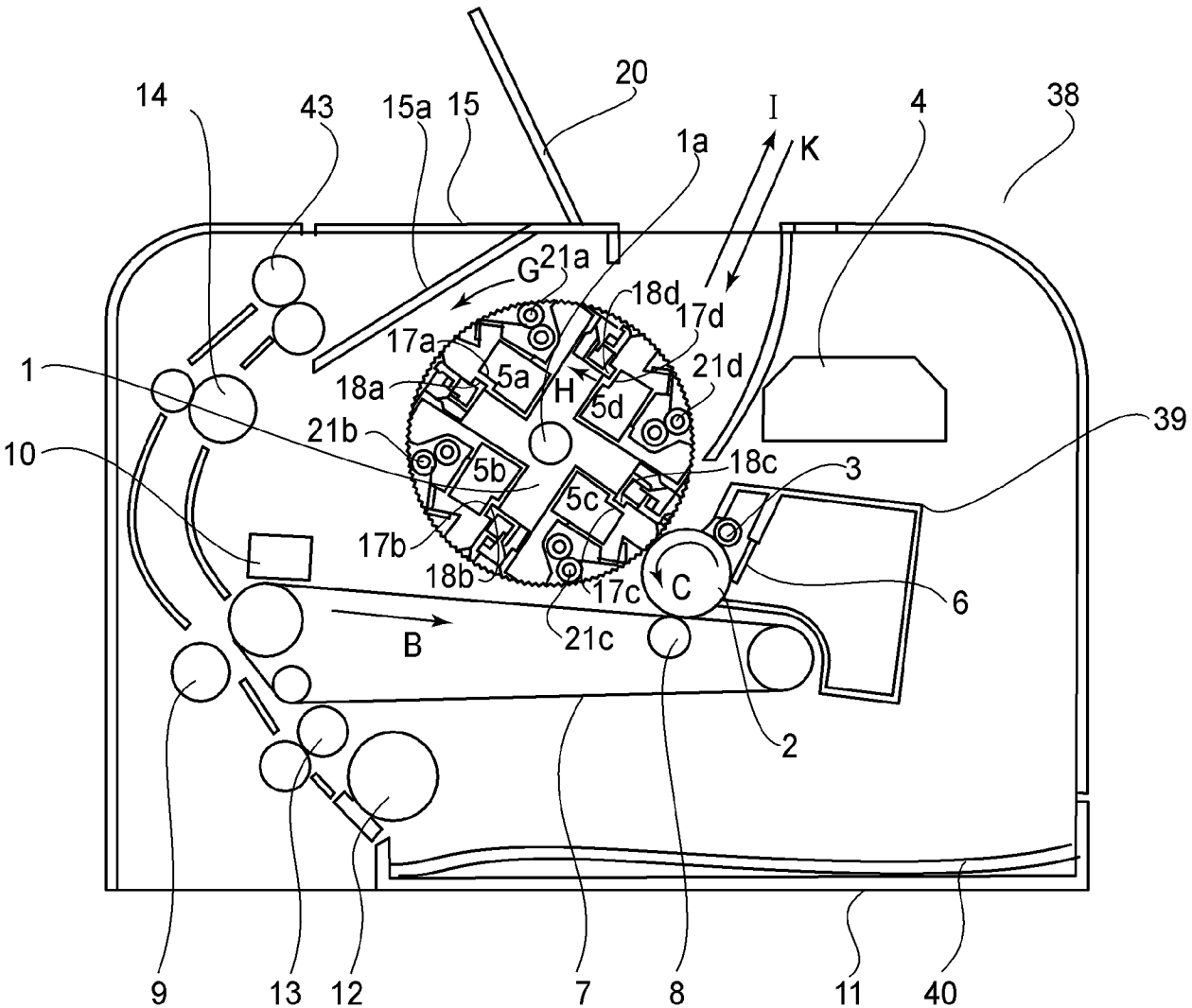
FIG. 10 is a sectional view of the electrophotographic image forming apparatus, and shows the general structure of the apparatus.

Referring to FIG. 10, as a cover 20 is opened, the development cartridge engaging member 18*d* retracts in the direction indicated by an arrow mark H in FIG. 10, disengaging from the rotary engaging portion 17*d* of the black development cartridge 5*d*. As a result, it becomes possible for the black development cartridge 5*d* to be removed from the apparatus main assembly 38 (rotary 1) in the direction indicated by an arrow mark I in FIG. 10, or mounted into the apparatus main assembly 38 (rotary 1) in the direction indicated by an arrow mark K in FIG. 10.

The yellow, magenta, cyan, and black development cartridges 5*a*, 5*b*, 5*c*, and 5*d*, respectively, are the same in the operation for mounting them and the operation for dismounting them. Thus, the operation for mounting the yellow development cartridge 5*a* and the operation for dismounting the yellow development cartridge 5*a* will be described as an example of mounting each development cartridge and an example of dismounting each development cartridge, respectively.

Figure 11:
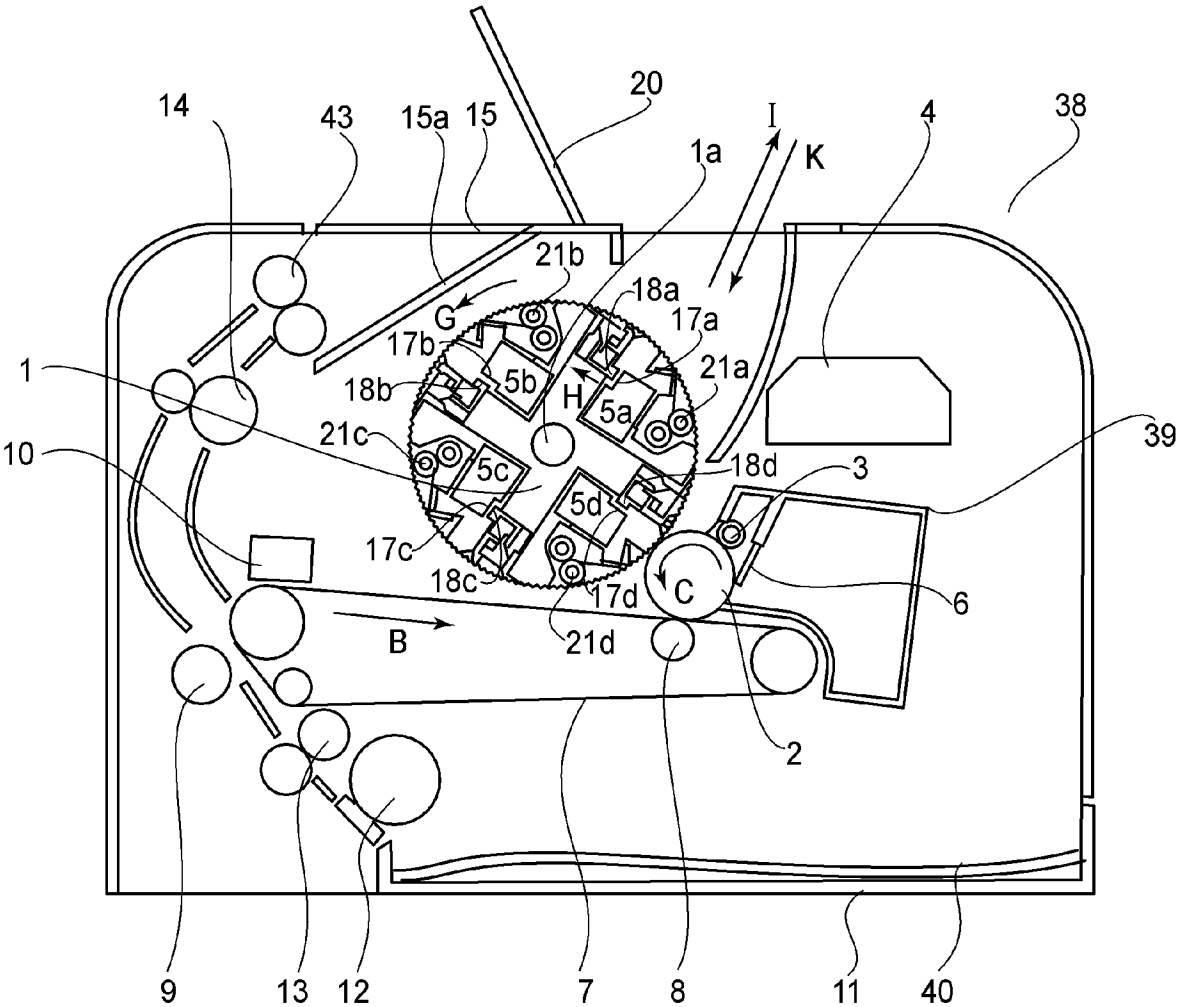
FIG. 11 is a sectional view of the electrophotographic image forming apparatus, and shows the general structure of the apparatus.

The yellow development cartridge 5*a* can be mounted into, or removed from, the apparatus main assembly 38 (rotary 1), only when the yellow development cartridge chamber is in the abovementioned mounting-and-dismounting position. As for the means for moving the yellow development cartridge chamber into the mounting-and-dismounting position, the driving force transmitting mechanism of the apparatus main assembly 38 can be used, or the rotary 1 may be manually moved into the mounting-and-dismounting position. Referring to FIG. 11, as the cover 20 is opened when the yellow development cartridge 5*a* (yellow development cartridge chamber) is in the mounting-and-dismounting position, the development cartridge engaging member 18*a* is made to retract in the direction indicated by the arrow mark H in FIG. 11 by the opening movement of the cover 20. As a result, it becomes possible for the yellow development cartridge 5*a* to be removed in the direction indicated by the arrow mark I in FIG. 11, or mounted in the direction indicated by the arrow mark K in FIG. 11.

Figure 12:
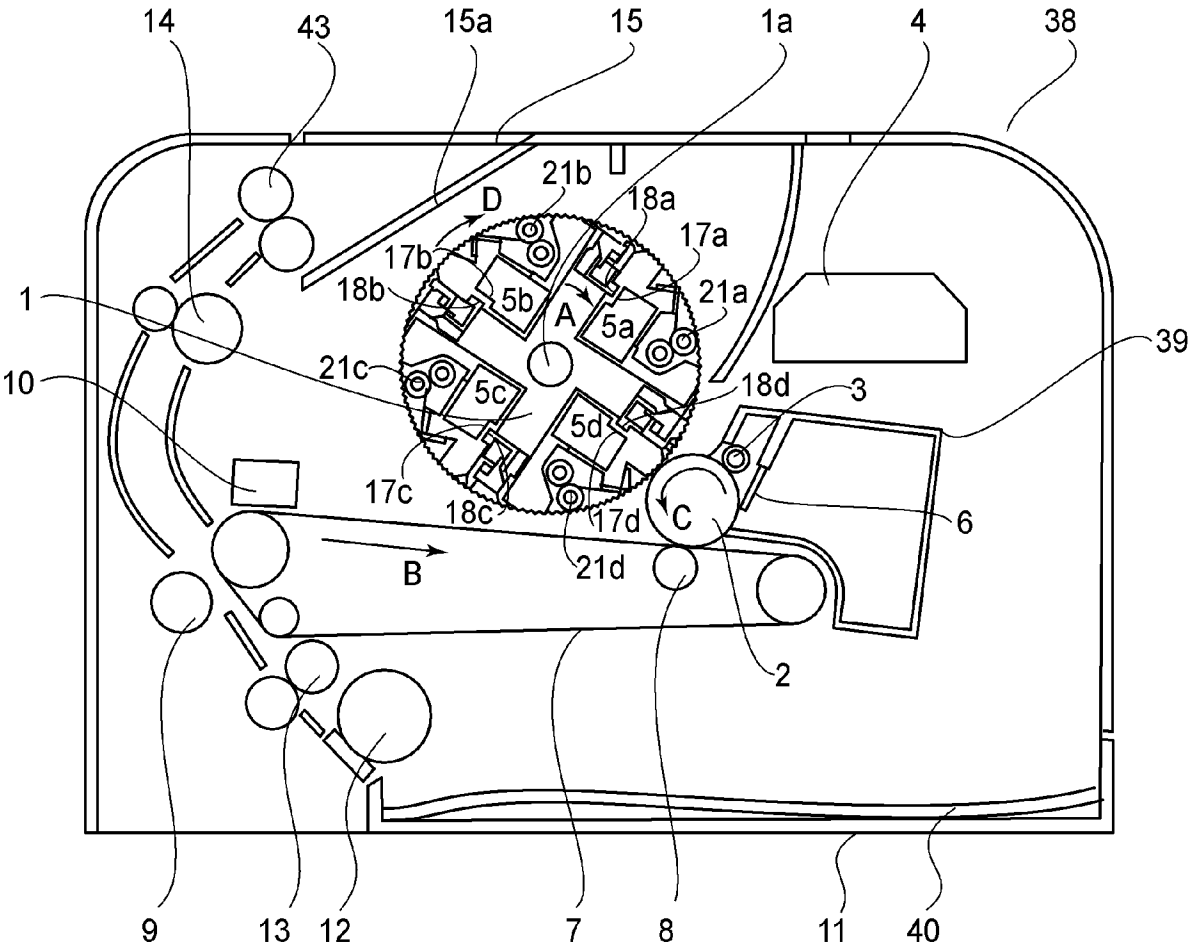
FIG. 12 is a sectional view of the electrophotographic image forming apparatus, and shows the general structure of the apparatus.

Referring to FIG. 12, as a user closes the cover 20, the development cartridge engaging member 18*a* is moved in the direction indicated by an arrow mark A in FIG. 12 by the closing movement of the cover 20, engaging thereby the rotary engaging portion 17*a* of the yellow development cartridge 5*a*. As a result, the yellow development cartridge 5*a* is prevented from popping out of the rotary 1.

(Description of Structural Arrangement for Supplying Rollers of Development Cartridge with Voltage from Image Forming Apparatus Main Assembly)

Next, referring to FIGS. 1, and 8(*c*)-17, the structural arrangement for supplying the toner supply roller 22 and development roller 21 of each development cartridge 5 with the voltage from the apparatus main assembly 38 will be described. The structural arrangements for supplying the developer supply rollers 22*a*, 22*b*, 22*c*, and 22*d* and development rollers 21*a*, 21*b*, 21*c*, and 21*d* of the development cartridges 5*a*, 5*b*, 5*c*, and 5*d*, respectively, with the voltage from the apparatus main assembly 38 are the same. Thus, the structural arrangement for supplying the development roller 21*a* of the yellow development cartridge 5*a* with the voltage from the apparatus main assembly 38 will be described as an example of the structural arrangement.

Figure 1:
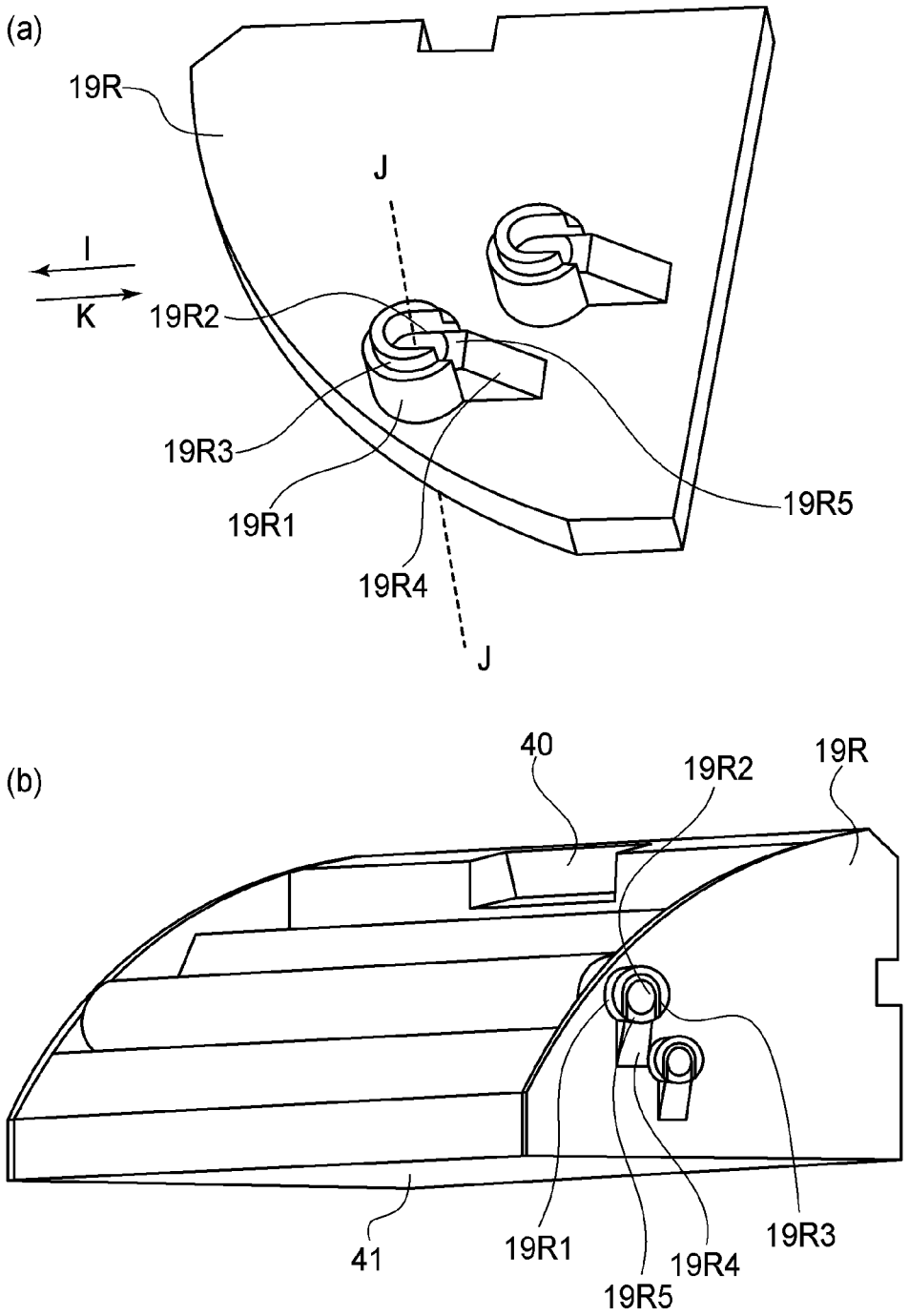
FIGS. 1(*a*) and 1(*b*) are perspective views of the supporting member for supporting the toner supply roller and development roller.
Figure 13:
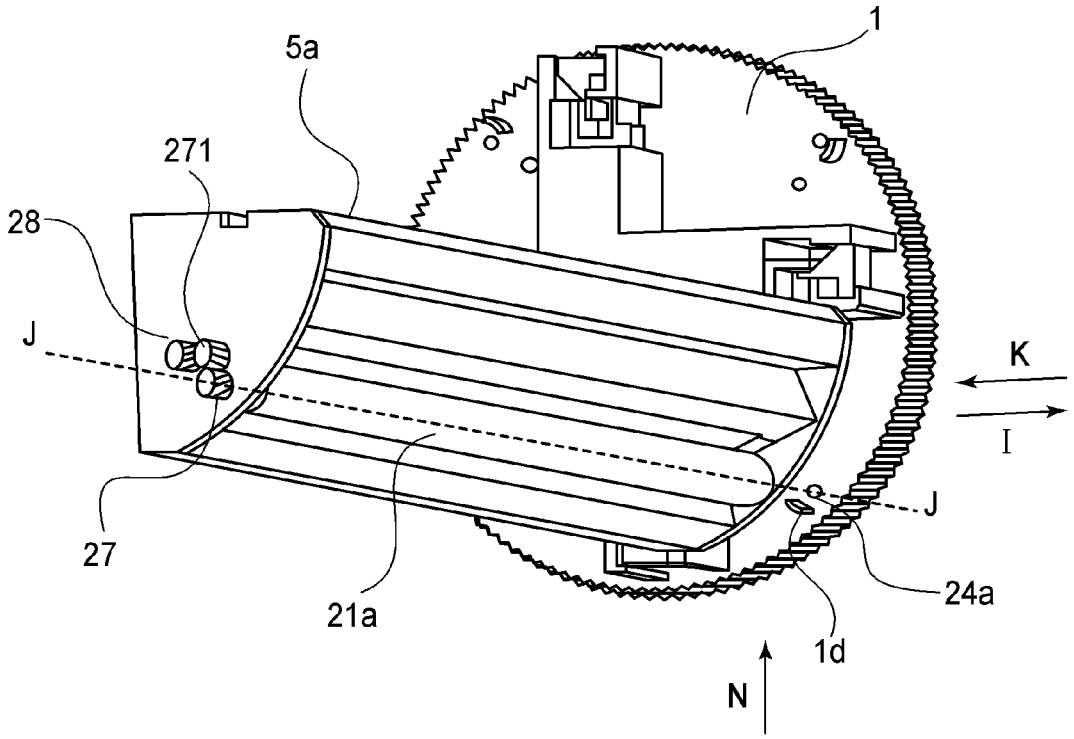
FIG. 13 is a perspective view of the combination of the rotary and one of the development cartridges.
Figure 14:
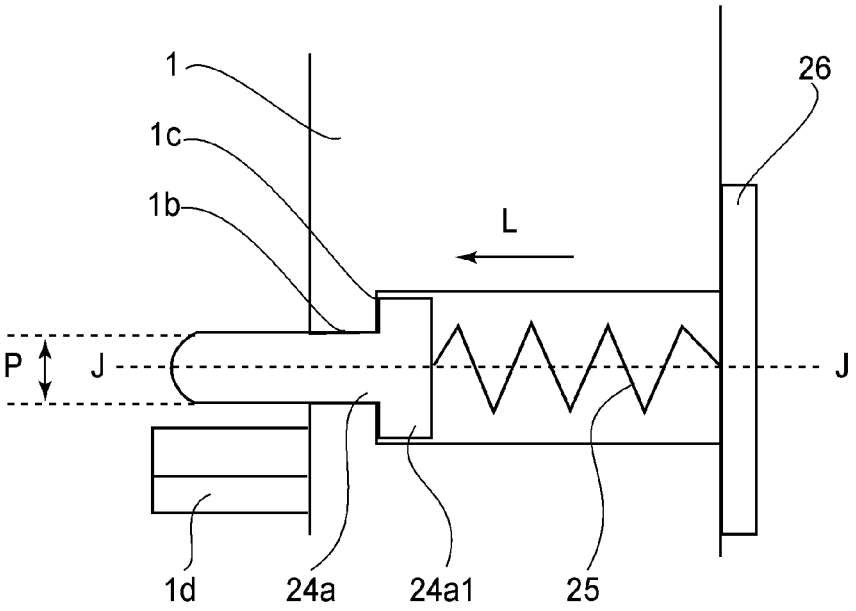
FIG. 14 is an enlarged schematic sectional view of the essential portions, inclusive of the electrical contacts of the main assembly, of the rotary, as seen from the direction from which the development cartridge is mounted, prior to the mounting of the development cartridge.
Figure 15:
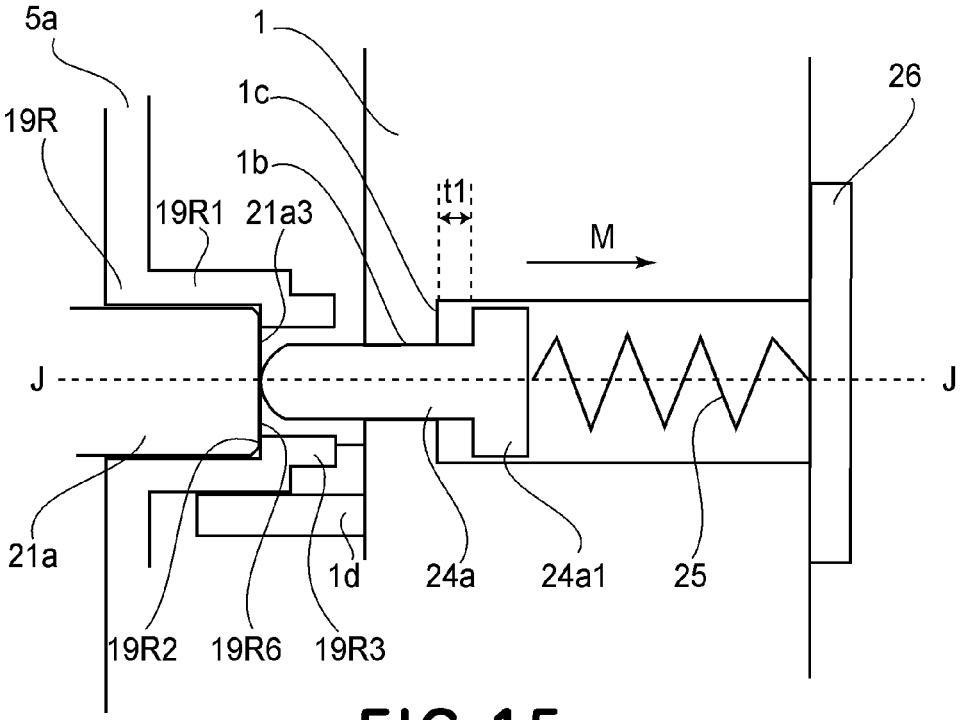
FIG. 15 is an enlarged schematic sectional view of the essential portions, inclusive of the electrical contacts of the main assembly, of the rotary and development cartridge, as seen from the direction from which the development cartridge is mounted, when the development cartridge is in the main assembly.
Figure 16:
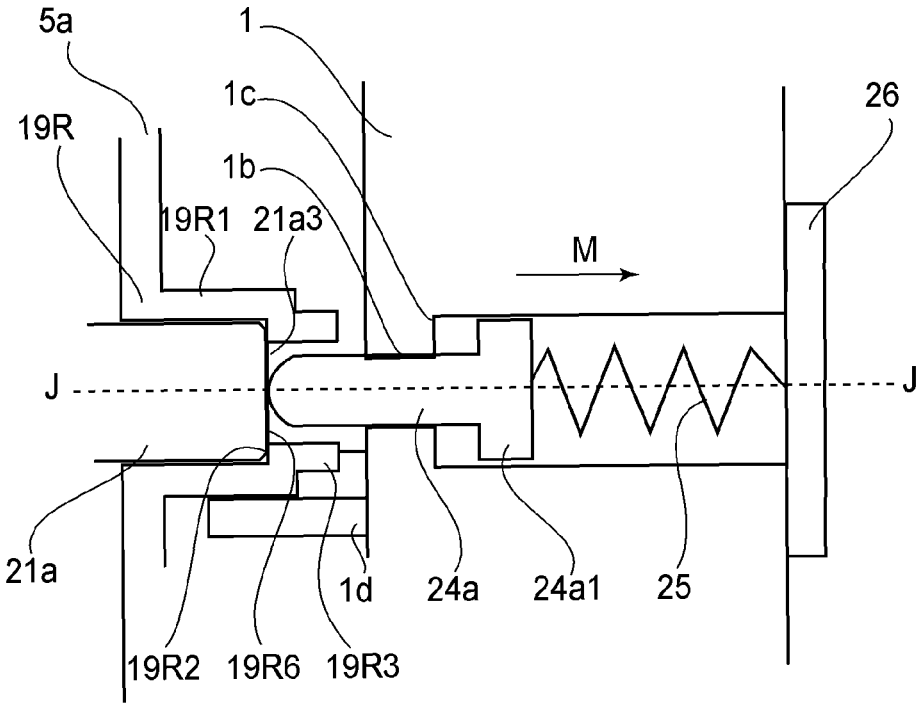
FIG. 16 is an enlarged schematic sectional view of the essential portions, inclusive of the electrical contacts of the main assembly, of the rotary and development cartridge, as seen from the direction from which the development cartridge is mounted, when the development cartridge is in the main assembly.
Figure 17:
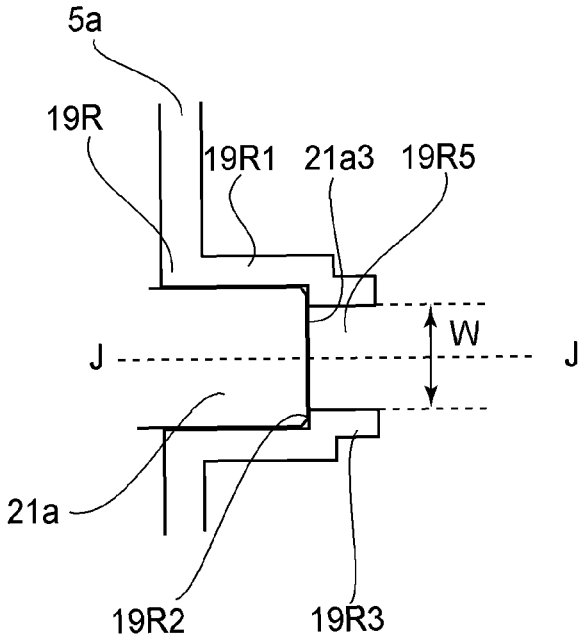
FIG. 17 is an enlarged schematic sectional view of the end of the development roller of the development cartridge, as seen from the direction from which the development cartridge is mounted.

FIG. 1(*a*) is a perspective view of the supporting member for the toner supply roller and development roller. FIG. 1(*b*) is a perspective view of the development cartridge. FIGS. 9-12 are sectional views of the electrophotographic image forming apparatus, and show the general structure of the apparatus. FIG. 13 is a perspective view of the combination of one (5*a*) of the development cartridges and the rotary 1. FIG. 14 is an enlarged schematic sectional view of the essential portions, inclusive of the electrical contacts of the main assembly, of the rotary, as seen from the direction from which the development cartridge is mounted, prior to the mounting of the development cartridge. FIGS. 15 and 16 are enlarged schematic sectional views of the essential portions, inclusive of the electrical contacts of the main assembly, of the rotary and development cartridge, as seen from the direction from which the development cartridge is mounted, when the development cartridge is in the main assembly. FIG. 17 is an enlarged schematic sectional view of the end of the development roller of the development cartridge, as seen from the direction from which the development cartridge is mounted.

Referring to FIG. 13, the apparatus main assembly 38 is provided with an electrical contact 24*a* for supplying the development roller 21*a* with voltage. In this embodiment, it is the rotary 1 of the apparatus main assembly 38 that is provided with the electrical contact 24*a*. The electrical contact 24*a* is positioned so that immediately after the mounting of the yellow development cartridge 5*a* into the apparatus main assembly 38, its position coincides with that of the rotational axis J of the development roller 21*a*. Incidentally, in this embodiment, an electrical contact formed of free-cutting steel (SUM24L) and KN-plated is used as the electrical contact 24*a*.

Next, referring to FIG. 14, the rotary 1 is provided with an engagement hole 1*b* in which the electrical contact 24*a* is fitted, and a regulating wall 1*c* for preventing the electrical contact 24*a* from popping out of the rotary 1 in the direction indicated by an arrow mark L in FIG. 14. The electrical contact 24*a* is held to the rotary 1 by a spring 24, which is for keeping the electrical contact 24*a* pressed in the direction indicated by an arrow mark L in FIG. 14, and a spring cover 26, while being allowed to move in the direction parallel to the rotational axis J of the development roller 21*a*. Further, the electrical contact 24*a* is provided with a flange portion 24*a*1 for preventing the accident that as the electrical contact 24*a* is pressed against the regulating wall 1*c* of the rotary 1, it pops out of the rotary 1 in the direction indicated by the arrow mark L in FIG. 14. Thus, the electrical contact 24*a* is prevented from popping out of the rotary 1 in the direction indicated by the arrow mark L in FIG. 14, when the yellow development cartridge 5*a* is not in the rotary 1.

Referring to FIG. 15, on the other hand, the supporting member 19R of the yellow development cartridge 5*a* is provided with a regulating portion 19R2 for regulating the movement of the development roller 21*a* in the direction parallel to the rotational axis J of the development roller 21*a*. This regulating portion 19R2 is the positioning portion for precisely positioning the lengthwise end surface 21*a*3 of the development roller 21*a*; as a part of the lengthwise end surface 21*a*3 of the development roller 21*a* comes into contact with the regulating portion 19R2, the lengthwise end surface 21*a*3 becomes precisely positioned. The regulating member 19R (regulating portion 19R2) is provided with a through hole 19R6, through which the lengthwise end surface 21*a*3 of the development roller 21*a* is partially exposed to allow the end surface 21*a*3 to directly contact the aforementioned electrical contact 24*a* of the apparatus main assembly 38. In other words, the supporting member 19R has the through hole 19R6 for partially exposing the end surface 21*a*3, and the regulating portion 19R2 (as the lengthwise end surface positioning portion) for precisely positioning the lengthwise end surface 21*a*3 by the other portion of the end surface 21*a*3. In this embodiment, the end surface 21*a*3, through which the development roller 21*a* is provided with electric power, is precisely positioned by the electrical contact 24*a* of the apparatus main assembly 38, by which the development roller 21*a* is directly provided with electric power. Therefore, not only is the end surface 21*a*3 more precisely positioned, but also, it is less exposed, providing thereby a special effect (it is possible to prevent electrically conductive grease adhered to end surface 21*a*3, from coming into contact with user). The regulating member 19R is structured so that the regulating portion 19R2 surrounds the through hole 19R6. However, the regulating portion 19R2 does not extends into the downstream side of the through hole 19R6 (part of end surface 21*a*3) in terms of the direction in which the yellow development cartridge 5*a* is mounted into the apparatus main assembly 38, in order to allow the electrical contact 24*a* to smoothly pass, as will be described later in detail. Incidentally, in this embodiment, the direction in which the cartridge 5 is mounted into, or dismounted from, the apparatus main assembly 38 (rotary 1), is intersectional (roughly perpendicular) to the rotational axis J (lengthwise direction) of the development roller 21*a*.

Therefore, as the yellow development cartridge 5*a* is mounted into the apparatus main assembly 38, the electrical contact 24*a* of the apparatus main assembly 38 comes into contact with the end surface 21*a*3 of the development roller 21*a* through the abovementioned through hole 19R6, and retracts in the direction indicated by an arrow mark M in FIG. 15. As a result, it becomes possible for the development roller 21*a* to be supplied with voltage. Since the main assembly electrical contact 24*a* is kept pressed upon the end surface 21*a*3 of the development roller 21*a* by a spring 25, it is ensured that the main assembly electrical contact 24*a* remains in contact with the end surface 21*a*3. Further, referring to FIG. 8(*c*), as driving force is transmitted to the yellow development cartridge 5*a* from the apparatus main assembly 38, the development roller 21*a* comes under the thrust generated in the direction indicated by the arrow mark M in FIG. 8(*c*) by a helical gear with which the development roller 21*a* is provided. Thus, the end surface 21*a*3 of the development roller 21*a*, in terms of the direction parallel to the rotational axis J of the development roller 21*a*, comes into contact with the regulating portion 19R2, being thereby controlled in position in terms of its axial direction (lengthwise direction). Therefore, it is possible to keep stable the state of contact between the main assembly electrical contact 24*a* and the end surface 21*a*3 of the development roller 21*a* when the driving force is transmitted from the apparatus main assembly 38 to the yellow development cartridge 5*a*. Incidentally, the choice of the structural arrangement for causing the end surface 21*a*3 of the development roller 21*a*, in terms of the direction parallel to the axial line J of the development roller 21*a*, to come into contact with the regulating portion 19R2 does not need to the above described one, which utilizes the thrust generated by the helical gear 27 as the driving force is transmitted to the development roller 21*a*. For example, a spring or the like may be used instead. In this embodiment, the supporting member 19R side, that is, one of the lengthwise end portions of the yellow development cartridge 5*a*, is structured, as described above, to ensure that the development roller 21*a* comes into, and remains in contact with, the main assembly electrical contact 24*a*; the supporting member 19L side, that is, the other lengthwise end portions of the yellow development cartridge 5*a*, is not structured to place the development roller 21*a* in contact with the main assembly electrical contact 24*a*. Instead, the supporting member 19L side is provided with the helical gear 28, and the driving force is transmitted from the helical gear 27 to the helical gear 28 through an idler gear 271.

Next, referring to FIGS. 13 and 15, the rotary 1 of the apparatus main assembly 38 is provided with four cartridge positioning portions 1*d* for precisely positioning the cartridges 5, one for one. The four cartridge positioning portions 1*d* are positioned with equal intervals, and next to the four electrical contacts 24*a*, one for one. The supporting member 19R of the yellow development cartridge 5*a* is provided with a supporting portion 19R1 for rotatably supporting one of the lengthwise end portions of the development roller 21*a*. The supporting portion 19R1 extends from the main portion of the supporting member 19R in the direction parallel to the axial line J (lengthwise direction) of the development roller 21*a*. Further, the supporting portion 19R1 functions as a positioning portion for precisely positioning the yellow development cartridge 5*a* relative to the apparatus main assembly 38 by engaging with the abovementioned positioning portion 1*d*. Thus, as the yellow development cartridge 5*a* is mounted into the rotary 1 of the apparatus main assembly 38, the peripheral surface of the supporting portion 19R1 engages with the inward surface of the positioning portion 1*d*. As a result, the yellow development cartridge 5*a* is supported by the rotary 1 in such a manner that the axial line J of the development roller 21*a* of the yellow development cartridge 5*a* coincides with the axial line of the main assembly electrical contact 24*a*; the main assembly electrical contact 24*a* is precisely positioned relative to the axial line J of the development roller 21*a*. Further, the contact point of the main assembly electrical contact 24*a* is made semispherical. Therefore, not only is the main assembly electrical contact 24*a* precisely positioned relative to the axial line of the development roller 21*a*, but also, the area of contact between the contact point of the main assembly electrical contact 24*a* and the end surface 21*a*3 of the development roller 21*a* is significantly smaller in size than the counterpart in accordance with the prior art, and therefore, the amount by which the end surface 21*a*3 and electrical contact 24*a* are shaved by each other is significantly smaller than the conventional amount.

Next, referring to FIGS. 15 and 16, in order to prevent the problem that the main assembly electrical contact 24*a* and the end surface 21*a*3 are shaved by each other as they rub each other in the area of contact, and also, to ensure that the development roller 21 is reliably supplied with voltage, the end surface 21*a*3 of the development roller 21*a* is coated with electrically conductive grease or the like. Coating the end surface 21*a*3 of the development roller 21*a*, which the main assembly electrical contact 24*a* contacts, with electrical conductive grease or the like makes it possible for a user to directly touch the electrical conductive grease, or for the electrically conductive grease to come into direct contact with the objects on a desk when the cartridge 21*a* is placed on the desk. Next, referring to FIGS. 1 and 15, in order to prevent these problems, the supporting member 19R is provided with a protective portion 19R3 for protecting the end surface 21*a*3, which functions as the input electrical contact of the development roller 21*a*. The protective portion 19R3 extends beyond the end surface 21*a*3 of the development roller 21*a*, which is under the regulation from the supporting portion 19R1, in the direction parallel to the axial line J (lengthwise direction) of the development roller 21*a*.

Next, referring to FIG. 1, the supporting member 19R has a passage 19R5 for allowing the main assembly electrical contact 24*a* to pass. In terms of the direction in which the yellow development cartridge 5*a* is mounted into the apparatus main assembly 38, the passage 19R5 is on the downstream side of the through hole 19R6. In this embodiment, the passage 19R5 is made by removing the downstream side of the protective portion 19R3 and supporting portion 19R1. The width W of the passage 19R5, which is shown in FIG. 17, is greater than the diameter P of the main assembly electrical contact 24*a*, which is shown in FIG. 14. The provision of the passage 19R5 prevents the protective portion 19R3 interfering with the main assembly electrical contact 24*a* when the yellow development cartridge 5*a* is mounted into the apparatus main assembly 38. The supporting portion 19R is structured so that as the end surface 21*a*3 (portions other than electrical contact) comes into contact with the regulating portion 19R2, it becomes virtually level with the bottom surface of the passage 19R5. Thus, this structural arrangement makes it easier to mount the cartridge 5 into, or remove the cartridge 5 from, the apparatus main assembly 38. Further, this structural arrangement makes it unnecessary to form a slanted surface for guiding the main assembly electrical contact 24*a* to the passage 19RT, making it possible to reducing the cartridge 5 in size. Incidentally, in this embodiment, when molding the supporting member 19R, the mold for forming the regulating portion 19R2, and the mold for forming the passage portion 19R5, are placed in contact with each other from the opposite directions from each other, in terms of the abovementioned lengthwise direction. Therefore, it is easier to make the end surface 21*a*3 virtually level with the passage portion 19R5. Further, referring to FIG. 1(*b*), the cartridge 5 is provided with a support portion 41, which makes contact with the surface on which it is placed outside the apparatus main assembly 38. The cartridge 5 is also provided with a handle 40, which is a top portion of the cartridge 5. When the cartridge 5 is in the above described state, and is seen from its lengthwise direction, the passage portion 19R5 is below the protective portion 19R3 (between protective portion 19R3 and support portion 41). The above described structural arrangement makes it difficult for a user to contact the end surface 21*a*3 through the passage 19R5.

What was described above is the structural arrangement for providing the development roller 21*a* of the yellow development cartridge 5*a* with the voltage from the apparatus main assembly 38. The structural arrangement for supplying the toner supply roller 22*a* with voltage is the same as that for supplying the development roller 21*a* with voltage.

(Method for Connecting Electrical Contacts of Development Cartridge with Electrical Contacts of Image Forming Apparatus Main Assembly When Mounting Development Cartridge into Image Forming Apparatus Main Assembly)

Next, referring to FIGS. 1, 2, 15, and 18, how the electrical contacts of the yellow development cartridge 5*a* become connected to the electrical contacts of the apparatus main assembly 38 will be described.

Figure 18:
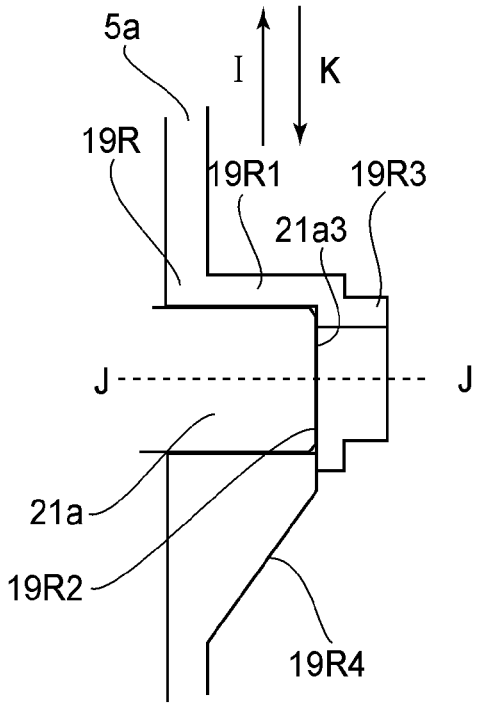
FIG. 18 is an enlarged schematic sectional view of the essential portions, inclusive of the electrical contacts of the main assembly, of the development cartridge, as seen from the direction perpendicular to the direction from which the development cartridge is mounted, prior to the mounting of the development cartridge.

FIG. 18 is an enlarged schematic sectional view of the essential portions of the yellow development cartridge 21*a*, as seen from the direction (direction indicated by arrow mark N in FIG. 13) perpendicular to the direction from which the yellow development cartridge 5*a* is mounted, prior to the mounting of the yellow development cartridge 5*a*. The supporting member 19R of the yellow development cartridge 5*a* has a guiding portion 19R4 for guiding the main assembly electrical contact 24*a* of the apparatus main assembly 38 to the passage 19R5 (end surface 21*a*3 of development roller 21*a*) when the development cartridge 5*a* is mounted into the apparatus main assembly 38. The guiding portion 19R4 is provided next to the passage 19R5, on the downstream side in terms of the cartridge mounting direction (indicated by arrow mark K in FIG. 18). The guiding portion 19R4 is a slanted surface, the upstream end of which is lower than its downstream end.

Next, referring to FIG. 15, when the main assembly electrical contact 24*a* of the apparatus main assembly 38 becomes connected to the end surface 21*a*3 of the development roller 21*a*, it compresses the spring 25 in the direction indicated by the arrow mark M by a distance t1. That is, before the main assembly electrical contact 24*a* comes into contact with the end surface 21*a*3 of the development roller 21*a* when the development cartridge 5*a* is mounted, the main assembly electrical contact 24*a* and supporting portion 19R1 overlap with each other in terms of the cartridge mounting direction (they are located so that they interfere with each other).

Figure 2:
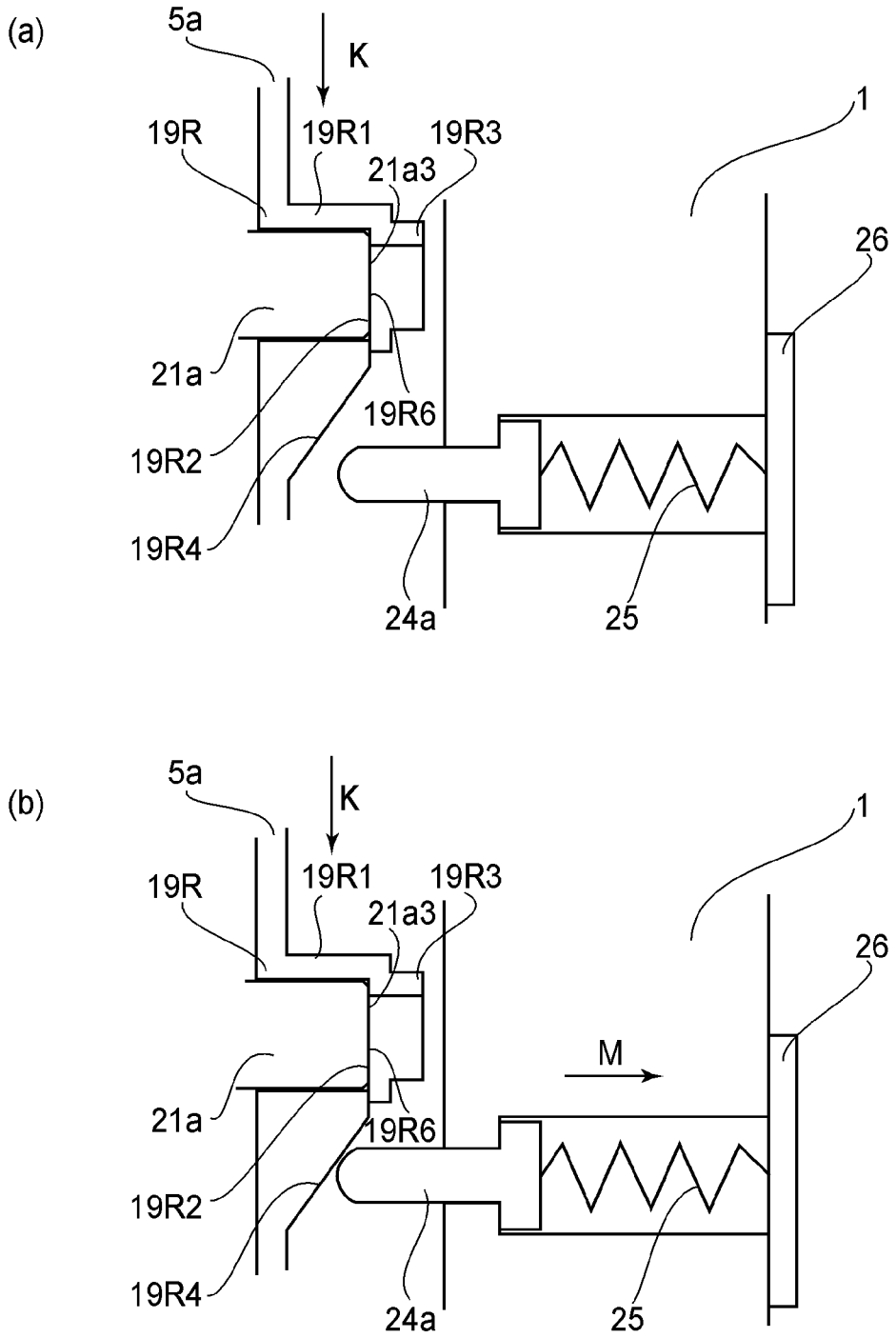
FIGS. 2(*a*) and 2(*b*) are enlarged sectional views of the essential portions of the development cartridge and rotary.
Figure 3:
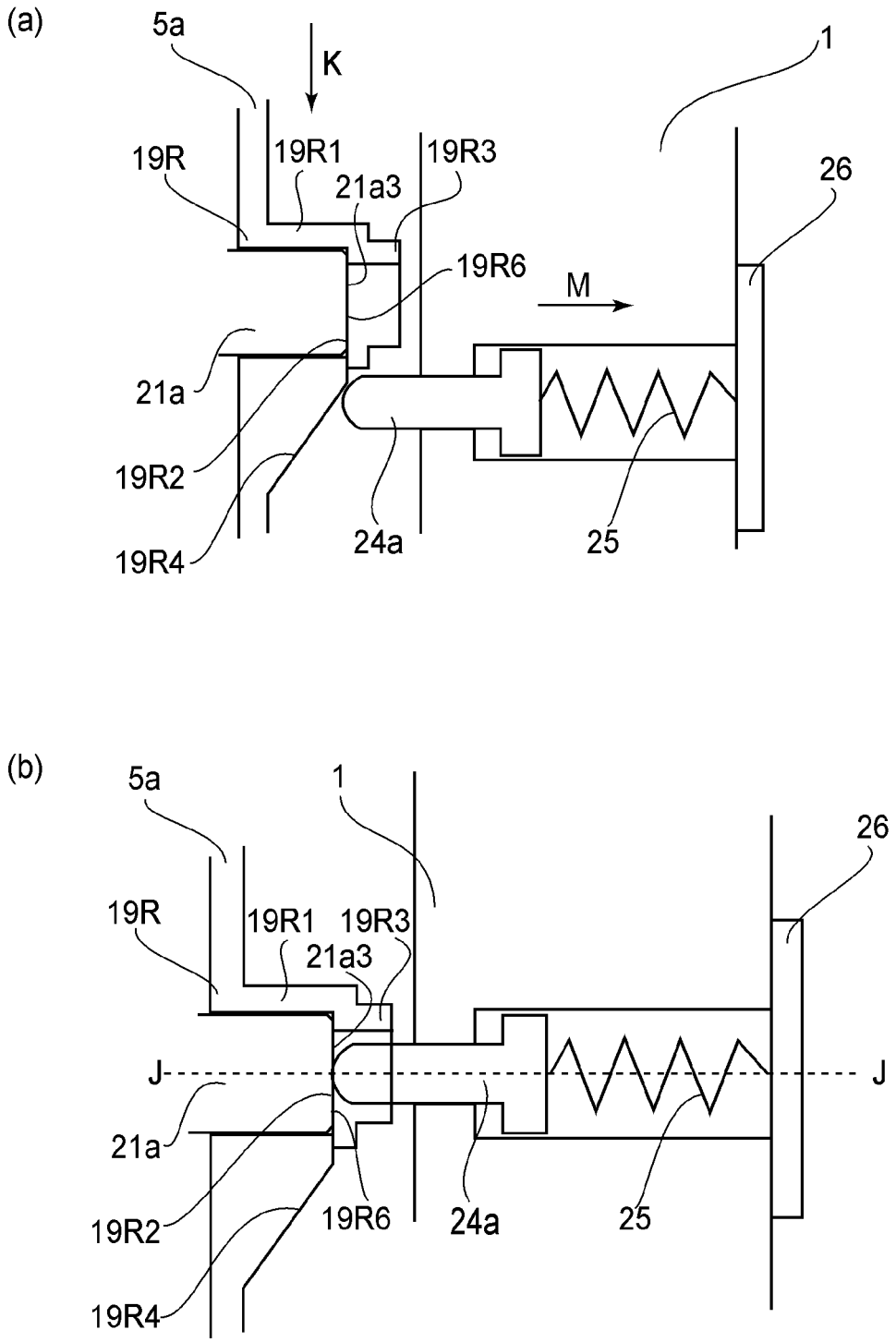
FIGS. 3(*a*) and 3(*b*) are also enlarged sectional views of the essential portions of the development cartridge and rotary.

Thus, in order to allow the main assembly electrical contact 24*a* of the apparatus main assembly 38 to smoothly enter the through hole 19R6 through the passage 19R5, the supporting member 19R is provided with the guiding portion 19R4 (FIG. 2(*a*)), which is on the downstream side of the supporting portion 19R1 of the supporting member 19R. Thus, while the yellow development cartridge 5*a* is mounted into the rotary 1 of the apparatus main assembly 38, the main assembly electrical contact 24*a* comes into contact with the guiding portion 19R4 as shown in FIG. 2(*b*). Then, as the yellow development cartridge 5*a* is advanced in the direction indicated by an arrow mark K in FIG. 3(*a*), the main assembly electrical contact 24*a* is guided by the guiding portion 19R4, being thereby made to gradually retract in the direction indicated by the arrow mark M in FIG. 3(*a*). Then, the main assembly electrical contact 24*a* enters the through hole 19R6 through the passage 19R5, being thereby guided to the end surface 21*a*3 of the development roller 21*a*, and comes into contact with the end surface 21*a*3. Therefore, the yellow development cartridge 5*a* is smoothly mountable in the apparatus main assembly 38, making it possible to reliably supply the development roller 21*a* with the voltage, without reducing the image forming apparatus in usability.

As described above, in this embodiment, the image forming apparatus is structured so that the end surface of one of the lengthwise ends of the development roller 21 in terms of the axial direction of the development roller 21 makes direction contact with the electrical contact of the apparatus main assembly 38. The employment of this structural arrangement can reduce, in count and cost, the components involved in the electrical connection between the apparatus main assembly 38 and development cartridge 5, and simplify in structure the components, without interfering with the reliability with which voltage is supplied from the apparatus main assembly 38 to the development cartridge 5.

Further, the supporting member 19R is provided with the protective portion 19R3 which extends from the main portion of the supporting member 19R in the abovementioned lengthwise direction of the development roller 21, beyond the end surface 21*a*3 of the development roller 21*a*, to protect the end surface 213. Thus, such a problem that a user touches the electrically conductive grease coated on the end surface 21*a*3 of the development roller 21 is prevented. Further, the supporting member 19R is provided with the passage 19R5, which is on the downstream side, in terms of the direction in which the development cartridge 5 is mounted into the apparatus main assembly, to allow the main assembly electrical contact 24*a* of the apparatus main assembly 38 to pass. Therefore, the protective portion 19R3 is prevented from interfering with the main assembly electrical contact 24*a* when the development cartridge 5 is mounted into the apparatus main assembly. In terms of the abovementioned lengthwise direction, at least a part of the protective portion 19R3 overlaps with at least a part of the regulating portion 19R2. Further, in terms of the lengthwise direction, the passage 19R5 is on the inward side of the protective portion 19R3. Moreover, the supporting portion 19R1 is structured so that after the proper mounting of the development cartridge 5, the bottom surface of the passage 19R5 is level with the end surface 21*a*3.

Further, the supporting member 19R has the supporting portion 19R1, as an engaging portion, which engages with the positioning portion 1*d*, which is located in the adjacency of the main assembly electrical contact 24*a* of the apparatus main assembly 38, with the presence of a preset amount of distance from the main assembly electrical contact 24*a*.

Therefore, as the development cartridge 5 is mounted into the rotary 1 of the apparatus main assembly 38, the peripheral surface of the supporting portion 19R1 engages with the inward circumferential surface of the positioning portion 1*d*. As a result, the rotary 1 supports the development cartridge 5 so that the axial line of the development roller 21 of the development cartridge 5 coincides with the axial line of the main assembly electrical contact 24*a*. That is, the supporting portion 19R1 is virtually cylindrical. Therefore, the main assembly electrical contact 24*a* of the apparatus main assembly 38 is precisely positioned on the rotational axis J of the development roller 21.

Further, the supporting member 19R has the guiding portion 19R4 which is on the downstream side of the through hole 19R6 in terms of the direction in which the development cartridge is mounted into the apparatus main assembly 38, and which guides the main assembly electrical contact 24*a* to the end surface 21*a*3 (one of end surfaces) of the development roller 21*a* in terms of the axial direction, when mounting the development cartridge into the apparatus main assembly. Therefore, when the development cartridge is mounted into the apparatus main assembly 38, the main assembly electrical contact 24*a* is guided to the end surface 21*a*3 of the development roller 21*a* along the guiding portion 19R4. Therefore, the development cartridge 5*a* is smoothly mountable into the apparatus main assembly 38, making it possible to reliably supply the development roller 21*a* with the voltage, without reducing in usability the image forming apparatus and the development cartridge therefor.

Here, this embodiment has been described with reference to the relationship between the development roller and the electrical contact on the apparatus main assembly. However, the structural arrangement for providing the toner supply roller for supplying the development roller with toner, with the voltage is the same as that for providing the development roller with voltage. Thus, the same effects as the effects described above regarding the development roller, can be obtained for the toner supply roller. Therefore, this embodiment can further simplify the development cartridge in structure and cost by reducing the component count.

[Embodiment 2]

Next, referring to FIGS. 19-23, the process cartridge removably mountable in the main assembly of an electrophotographic image forming apparatus will be described. The structural arrangement, in the second preferred embodiment, for supplying the process cartridge with electric power is roughly the same as that in the first preferred embodiment. Thus, the components, portions, etc., of the image forming apparatus in the second embodiment, which are the same in description, will be given the same referential codes as those given to their counterparts in the first embodiment, and will not be described here.

(Description of Process Cartridge)

Figure 19:
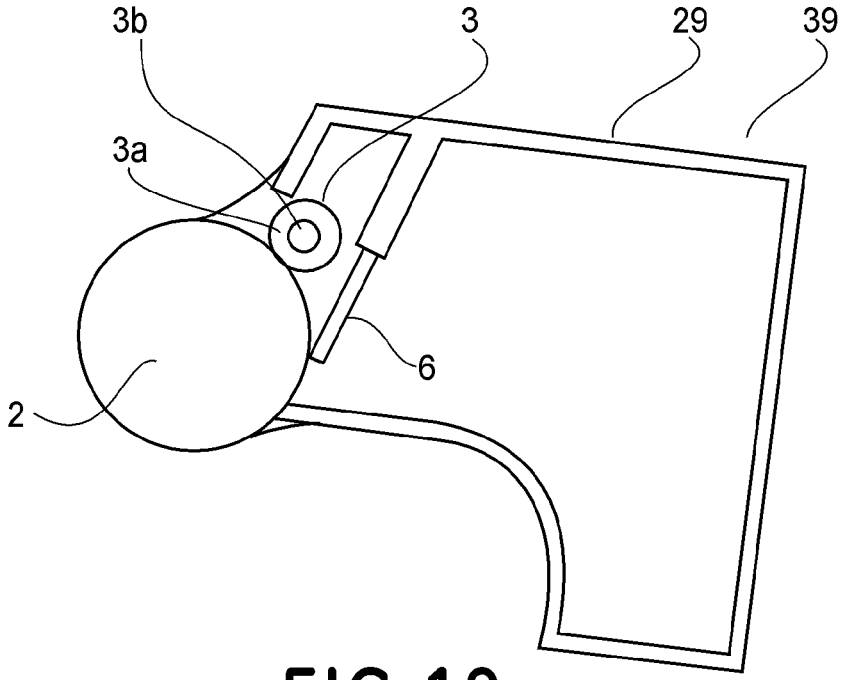
FIG. 19 is a sectional view of the process cartridge 39.
Figure 20:
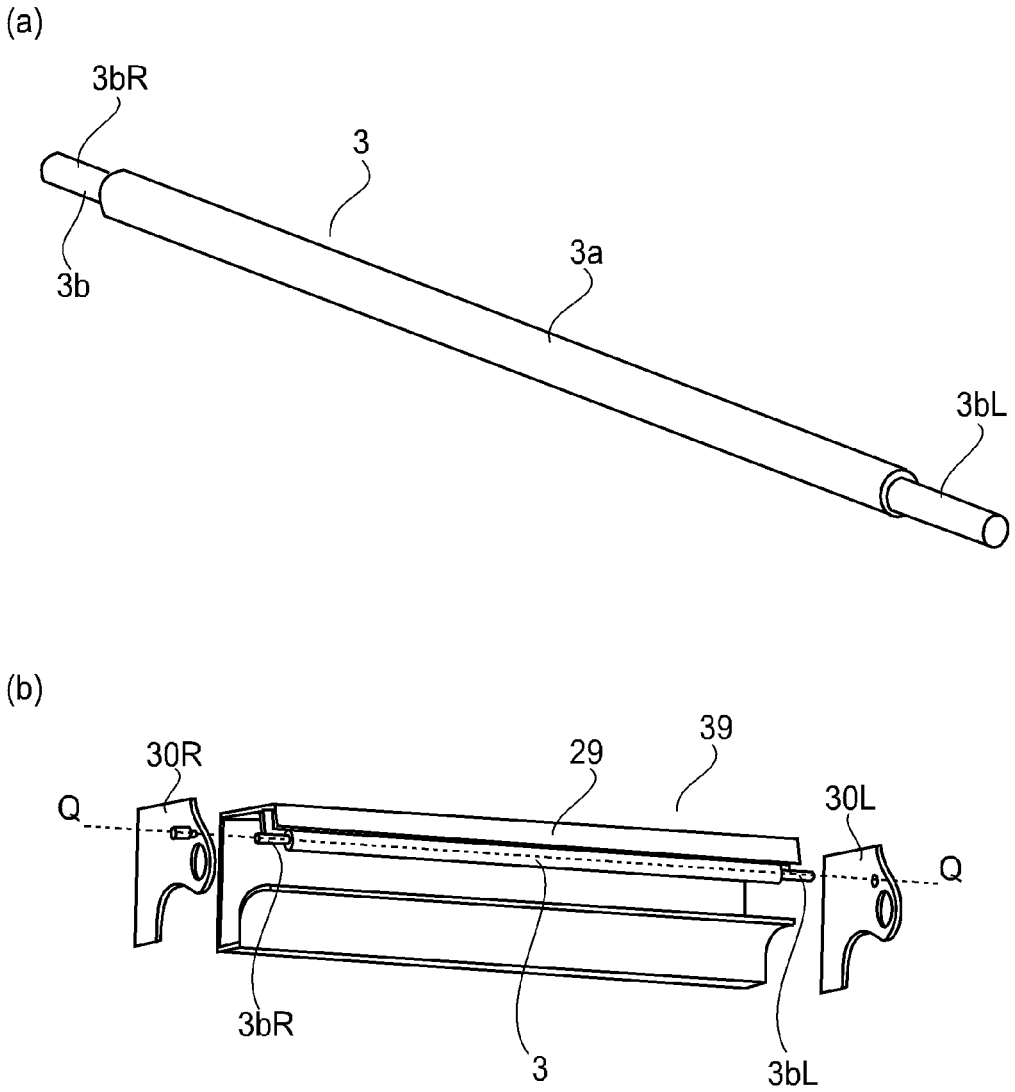
FIG. 20(*a*) is a perspective view of the charge roller, and FIG. 20(*b*) is an exploded perspective view of the process cartridge, which shows how the roller is supported.

First, referring to FIGS. 5-7, and 19-20, a process cartridge 39 will be described. FIG. 19 is a sectional view of the process cartridge 39. FIG. 20(*a*) is a perspective view of the charge roller, and FIG. 20(*b*) is a perspective view of the process cartridge, shows the structural arrangement for supporting the rollers of the process cartridge.

The process cartridge 39 is a process cartridge made by integrally placing the photosensitive drum 2, and process means, more specifically, the charging means 3 and cleaning means 6 for processing the photosensitive drum 2, in a cartridge. It is removably mountable in the apparatus main assembly 38. The charging mean 3 uniformly charges the photosensitive drum 2 prior to the formation of a latent image. The cleaning means 6 removes the toner particles remaining on the photosensitive drum 2 after the transfer of a toner image from the photosensitive drum 2. It stores the removed toner particles in the cleaning means container 29.

First, the structure of the charging means 3 will be described. The charging means 3 in this embodiment is in the form of a roller. Thus, the charging means 3 will be referred to as a charge roller 3 hereafter. The charge roller 3 is for charging the photosensitive drum 2. Referring to FIG. 20(*a*), the charge roller 3 is made up of a rubber roller 3*a* and a shaft 3*b*. The shaft 3*b* is put through the rubber roller 3*a* in the direction parallel to the rotational axis of the charge roller 2. The lengthwise ends of the shaft 3*b* extend from the lengthwise ends of the rubber roller 3*a*, one for one, and will be referred to as end portions 3*b*L and 3*b*R, respectively, hereafter. Next, referring to FIG. 20(*b*), the charge roller 3 is rotatably supported by a pair of supporting members 30L and 30R; the end portions 3*b*L and 3*b*R are rotatably supported by the supporting members 30L and 30R, respectively. The charge roller 3 is supplied with the voltage for charging the photosensitive drum 2, by the apparatus main assembly 38.

(Method for Mounting Process Cartridge into Main Assembly of Image Forming Apparatus, and Method for Removing Process Cartridge from Main Assembly of Image Forming Apparatus)

Next, referring to FIG. 21, the operation for mounting the process cartridge 39 into the apparatus main assembly 38, and the operation for dismounting the process cartridge 39 from the apparatus main assembly 38, will be described.

Figure 21:
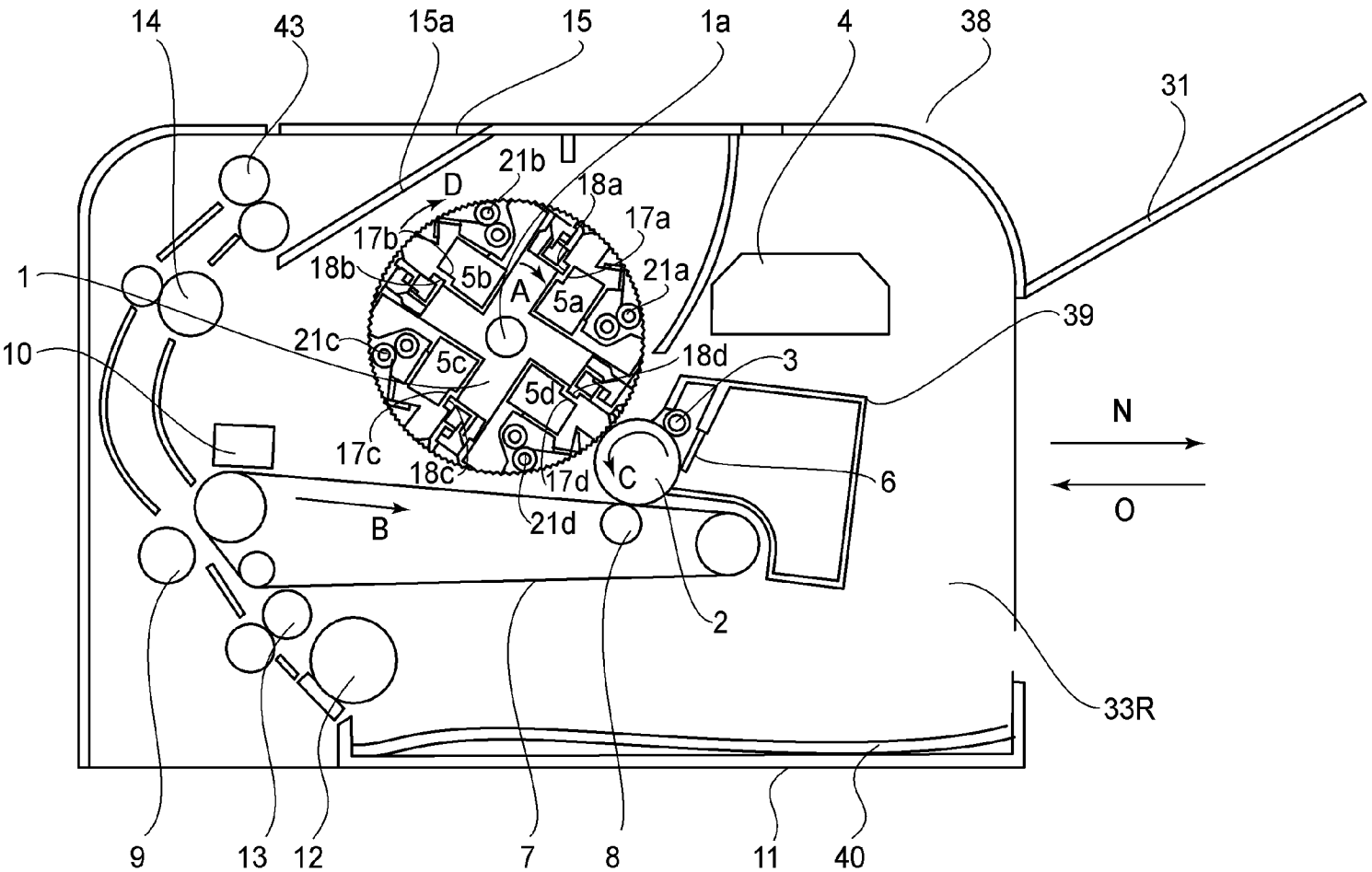
FIG. 21 is a sectional view of the electrophotographic image forming apparatus, and shows the general structure thereof.

Referring to FIG. 21, first, a cover 31 is to be opened. As the cover 31 is opened, it becomes possible for the process cartridge 39 to be dismounted from, or mounted into, the apparatus main assembly 38 in the directions indicated by arrow marks N and O, respectively. The direction indicated by the arrow mark N is the direction in which the process cartridge 39 is to be dismounted, and the direction indicated by the arrow mark O is the direction in which the process cartridge 39 is to be mounted.

(Description of Structural Arrangement for Supplying Charge Roller with Voltage from Main Assembly of Image Forming Apparatus)

Next, referring to FIGS. 22-24(*a*), the structural arrangement for supplying the charge roller 3 of the process cartridge 39 with the voltage from the main assembly 38 of the image forming apparatus will be described.

Figure 22:
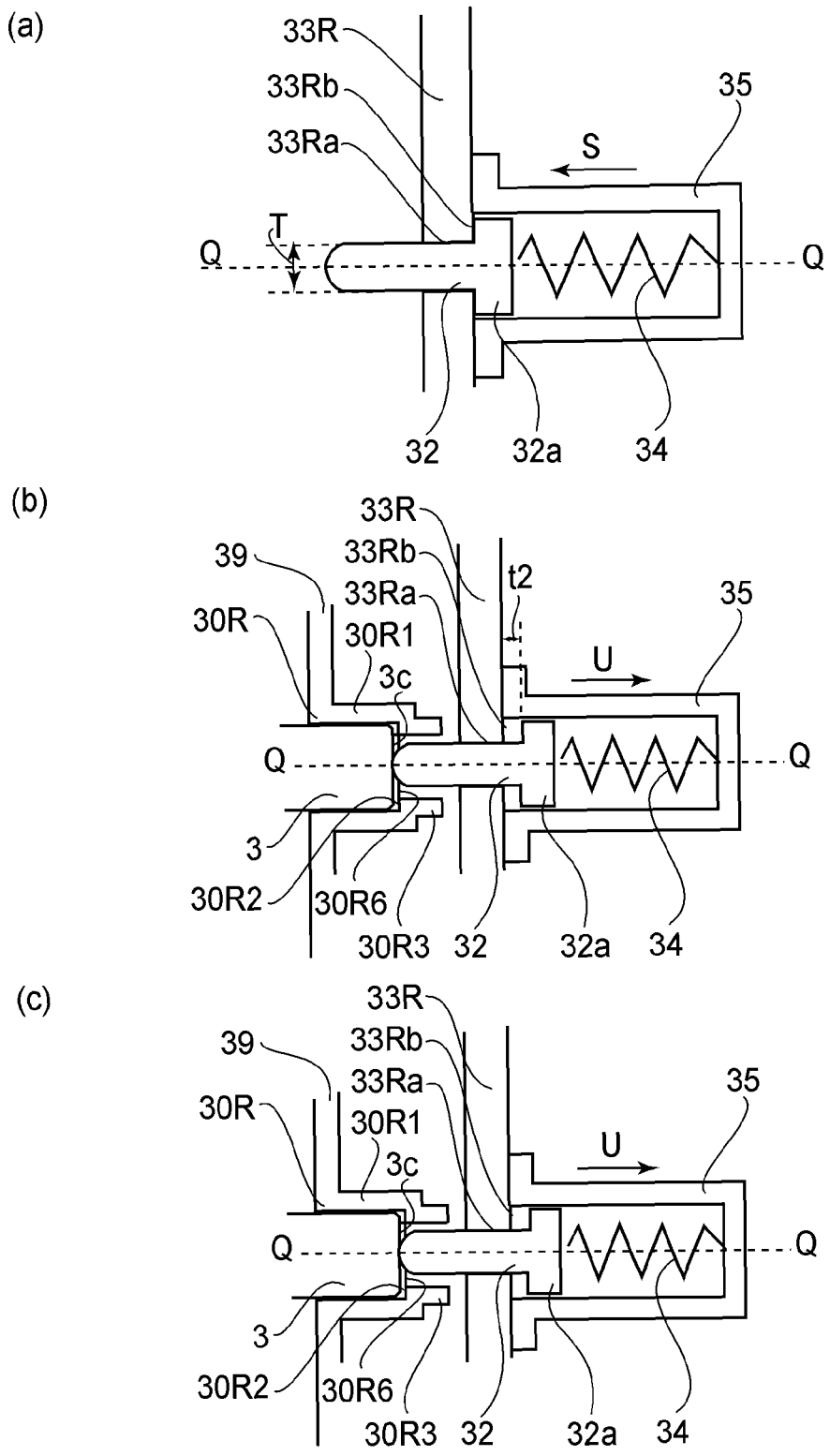
FIGS. 22(*a*), 22(*b*), and 22(*c*) are schematic enlarged sectional views of the electrical contacts of the main assembly, as seen from the direction from which the process cartridge is mounted, prior to, during, and after the proper mounting of the process cartridge, respectively.

FIG. 22 is an enlarged sectional view of the main assembly electrical contacts, as seen from the direction in which the process cartridge 39 is mounted, prior to the mounting of the process cartridge 39. FIGS. 22(*b*) and 22(*c*) are enlarged sectional views of the main assembly electrical contact, and the essential portions of the process cartridge 39, when the process cartridge 39 is in the apparatus main assembly 38. FIG. 23 is a perspective view of one of the charge roller supporting members of the process cartridge 39. FIG. 24(*a*) is an enlarged sectional view of the one of the end portions of the charge roller 3 of the process cartridge 39, as seen from the direction in which the process cartridge 39 is mounted into the apparatus main assembly 38.

Referring to FIG. 22, the apparatus main assembly 38 is provided with an electrical contact 32 for supplying the charge roller 3 with voltage. This electrical contact 32 is positioned so that when the process cartridge 39 is in its image forming position in the apparatus main assembly 38, it will be on the rotational axis Q of the charge roller 3.

Also referring to FIG. 22, the right side plate 33R of the main assembly 38 of the image forming apparatus is provided with an electrical contact engagement hole 33Ra in which the main assembly electrical contact 32 engages, and a regulating wall 33Rb for preventing the main assembly electrical contact 32 from popping out of the side plate 33R in the direction indicated by an arrow mark S in FIG. 22. The main assembly electrical contact 32 is held to the side plate 33R by a spring 34, which is for keeping the electrical contact 32 pressed in the direction indicated by an arrow mark S in FIG. 22, and a spring cover 35, while being allowed to move, relative to the side plate 33R, in the direction parallel to the rotational axis Q of the charge roller 3. Further, the electrical contact 32 is provided with a flange portion 32*a* for preventing the accident that as the electrical contact 32 is pressed against the regulating wall 33Rb of the side plate 33R, it pops out of the side plate 33R in the direction indicated by the arrow mark S in FIG. 22. Thus, the electrical contact 32 is prevented from popping out of the side plate 33R in the direction indicated by the arrow mark S in FIG. 22, when the process cartridge 39 is not in the apparatus main assembly 38.

Referring to FIG. 22(*b*), on the other hand, the supporting member 30R of the process cartridge 39 is provided with a regulating portion 30R2 for regulating the movement of the charge roller 3 in the direction parallel to the rotational axis Q of the charge roller 3. This regulating portion 30R2 is the positioning portion for precisely positioning the lengthwise end surface 3*c* of the charge roller 3; as the lengthwise end surface 3*c* of the charge roller 3 comes into contact with the regulating portion 30R2, the lengthwise end surface 3*c* becomes precisely positioned. The regulating portion 30R2 is provided with a through hole 30R6, through which the lengthwise end surface 3*c* of the charge roller is allowed to directly contact the aforementioned electrical contact 32 of the apparatus main assembly 38. The structures and functions of the through holes 30R6 and regulating portion 30R2, and the direction in which the process cartridge 39 is mounted into, or dismounted from, the apparatus main assembly 38, are the same as those in the first preferred embodiment.

Thus, as the process cartridge 39 is mounted into the apparatus main assembly 38, the main assembly electrical contact 32 comes into contact with the end surface 3*c* of the charge roller 3 through the through hole 30R6, being thereby enabled to supply the charge roller 3 with voltage, and retracts in the direction indicated by an arrow mark U in FIG. 22(*b*). The main assembly electrical contact 32 is under the pressure applied to the end surface 3*c* of the charge roller 3 by the spring 34, being ensured to remain in contact with the end surface 3*c*. Next, referring to FIG. 22(*c*), as driving force is transmitted to the process cartridge 39 from the apparatus main assembly 38, the end surface 3*c* of the charge roller 3, that is, one of the end surfaces of the charge roller 3 in terms of the direction parallel to the axial line Q of the charge roller 3, is subjected to a force directed as indicated by an arrow mark U in FIG. 22 (*c*). Thus, the end surface 3*c* of the charge roller 3 in terms of the direction parallel to the axial line Q of the charge roller 3 comes into contact with the regulating portion 30R2, being thereby precisely positioned in terms of its axial direction (lengthwise direction). Therefore, it is possible to reliably keep the main assembly electrical contact 32 in contact with the end surface 3*c* of the charge roller 3 when the driving force is transmitted to the process cartridge 39 from the apparatus main assembly 38. Next, referring to FIG. 29, as for the structural arrangement for subjecting the charge roller 3 to the force, the direction of which is indicated by the arrow mark U in FIG. 22(*c*), the charge roller 3 is supported by the supporting members 30L and 30R in such a manner that the rotational axis W of the charge roller 3 intersects with the rotational axis Y of the photosensitive drum 2 at an angle of Z. Thus, as the photosensitive drum 2 is rotated in the direction indicated by an arrow mark C in FIG. 21, the charge roller 3 is subjected to the force from the photosensitive drum 2, the direction of which is indicated by the arrow mark U in FIG. 22(*c*). Incidentally, the structural arrangement for causing the end surface 3*c* of the charge roller 3 in terms of the direction parallel to the axial line Q of the charge roller 3, to come into contact with the regulating portion 30R2, may be replaced with a pair of helical gears or a spring designed to thrust the charge roller 3 in the direction indicated by the arrow mark U in FIG. 22(*c*).

Further, the side plate 33R of the apparatus main assembly 38 is provided with four positioning portions (unshown), one for each of the four main assembly electrical contacts 32 (unshown). Each positioning portion is in the adjacency of the corresponding main assembly electrical contact 32, with the presence of a preset amount of distance from the main assembly electrical contact 32. These positioning portions are the same in structure as those in the first preferred embodiment. Further, the supporting member 30R of the process cartridge 39 is provided with a supporting portion 30R1, which rotatably supports one of the lengthwise ends of the charge roller 3. The supporting portion 30R1 of the supporting member 30R extends from the main portion of the supporting member 30R in the direction (lengthwise direction) parallel to the axial line Q of the charge roller 3. Further, the supporting portion 30R1 functions as a positioning portion for precisely positioning the process cartridge 39 relative to the apparatus main assembly 38 by engaging with the abovementioned positioning portion (unshown) of the apparatus main assembly 38. Thus, as the process cartridge 39 is mounted into the apparatus main assembly 38, the abovementioned supporting portion 30R1 engages with the positioning portion (unshown). As a result, the process cartridge 39 is supported by the apparatus main assembly 38 in such a manner that the axial line Q of the charge roller 3 of the process cartridge 39 coincides with the axial line of the main assembly electrical contact 32; the main assembly electrical contact 32 is precisely positioned relative to the axial line Q of the charge roller 3. Further, the contact point portion of the main assembly electrical contact 32 is made semispherical. Thus, not only is the main assembly electrical contact 32 precisely positioned relative to the axial line Q of the charge roller 3, but also, the area of contact between the contact point of the main assembly electrical contact 32 and the end surface 3*c* of the charge roller 3 is significantly smaller is size than the counterpart in accordance with the prior art, and therefore, the amount by which the end surface 3*c* and main assembly electrical contact 32 are shaved by each other is significantly smaller than the conventional amount.

Next, referring to FIGS. 15 and 16, in order to prevent the problem that the main assembly electrical contact 32 and the end surface 3*c* are shaved by each other as they rub against each other in the area of contact, and also, to ensure that the charge roller 3 is reliably supplied with voltage, the end surface 3*c* of the charge roller 3 is coated with electrically conductive grease or the like. Coating the end surface 3*c* of the charge roller 3, which the main assembly electrical contact 32 contacts, with electrical conductive grease or the like makes it possible for a user to directly touch the electrical conductive grease, or for the electrically conductive grease to come into direct contact with the objects on a desk when the cartridge 21*a* is placed on the desk. Thus, in order to prevent these problems, the supporting member 30R is provided with a protective portion 30R3 (protrusive portion) for protecting the end surface 3*c*, which functions as the input electrical contact of the charge roller 3, as shown in FIGS. 22(*c*) and 23. The protective portion 30R3 extends beyond the end surface 3*c* of the charge roller 3, which is under the regulation from the regulating portion 30R2 in the direction parallel to the axial line Q (lengthwise direction) of the charge roller 3.

Figure 23:
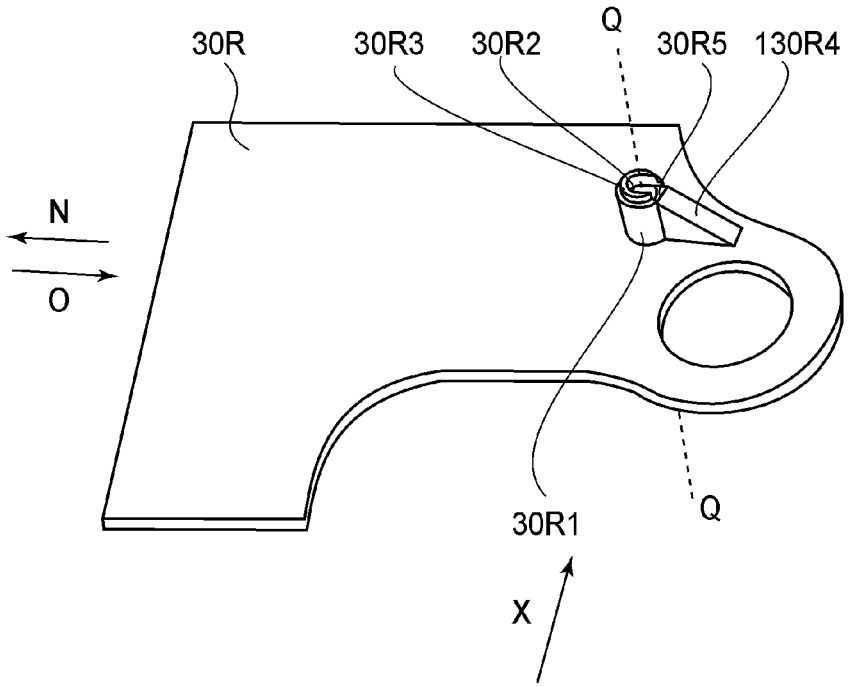
FIG. 23 is a perspective view of the charge roller supporting member of the process cartridge.
Figure 25:
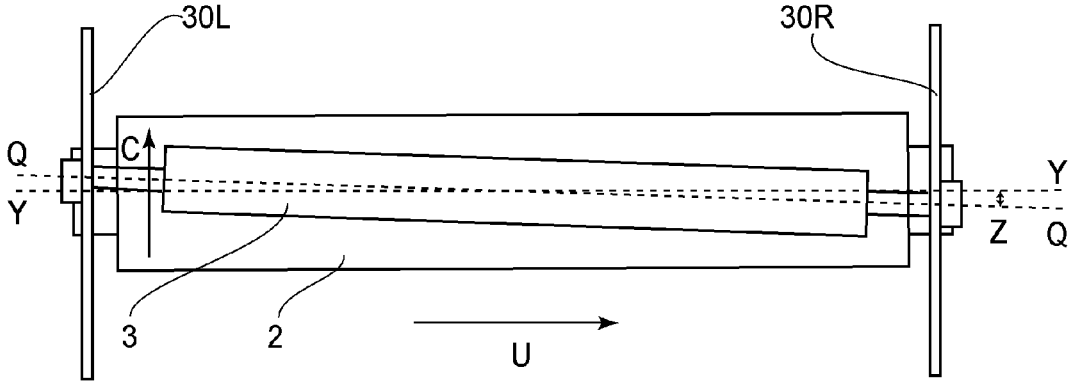
FIG. 25 is a schematic side view of the charge roller and its adjacencies, which shows one of the examples of the structural arrangement for applying force to the charge roller in the direction parallel to the axial line of the charge roller.

Next, referring to FIG. 23, the supporting member 30R3 and supporting portion 30R1 are provided with a passage 30R5 for allowing the main assembly electrical contact 32 to pass. In terms of the direction in which the process cartridge 39 is mounted into the apparatus main assembly 38, the passage 30R5 is on the downstream side of the through hole 30R6. The width V of the passage 30R5, which is shown in FIG. 24(*a*), is greater than the diameter T of the main assembly electrical contact 32, which is shown in FIG. 22. The provision of the passage 30R5 prevents the protective portion 30R3 interfering with the main assembly electrical contact 32 when the process cartridge 39 is mounted into the apparatus main assembly 38. The structures and functions of the protective portion 30R3 and passage 30R5 are the same as the counterparts in the first preferred embodiment.

(Method for Connecting Electrical Contacts of Process Cartridge with Electrical Contacts of Image Forming Apparatus Main Assembly When Mounting Process Cartridge into Image Forming Apparatus Main Assembly)

Next, referring to FIGS. 23, 24(*b*), and 24(*c*), how the electrical contact of the process cartridge 39 becomes connected with the main assembly electrical contact 32 when the process cartridge 39 is mounted into the apparatus main assembly 38 will be described.

Figure 24:
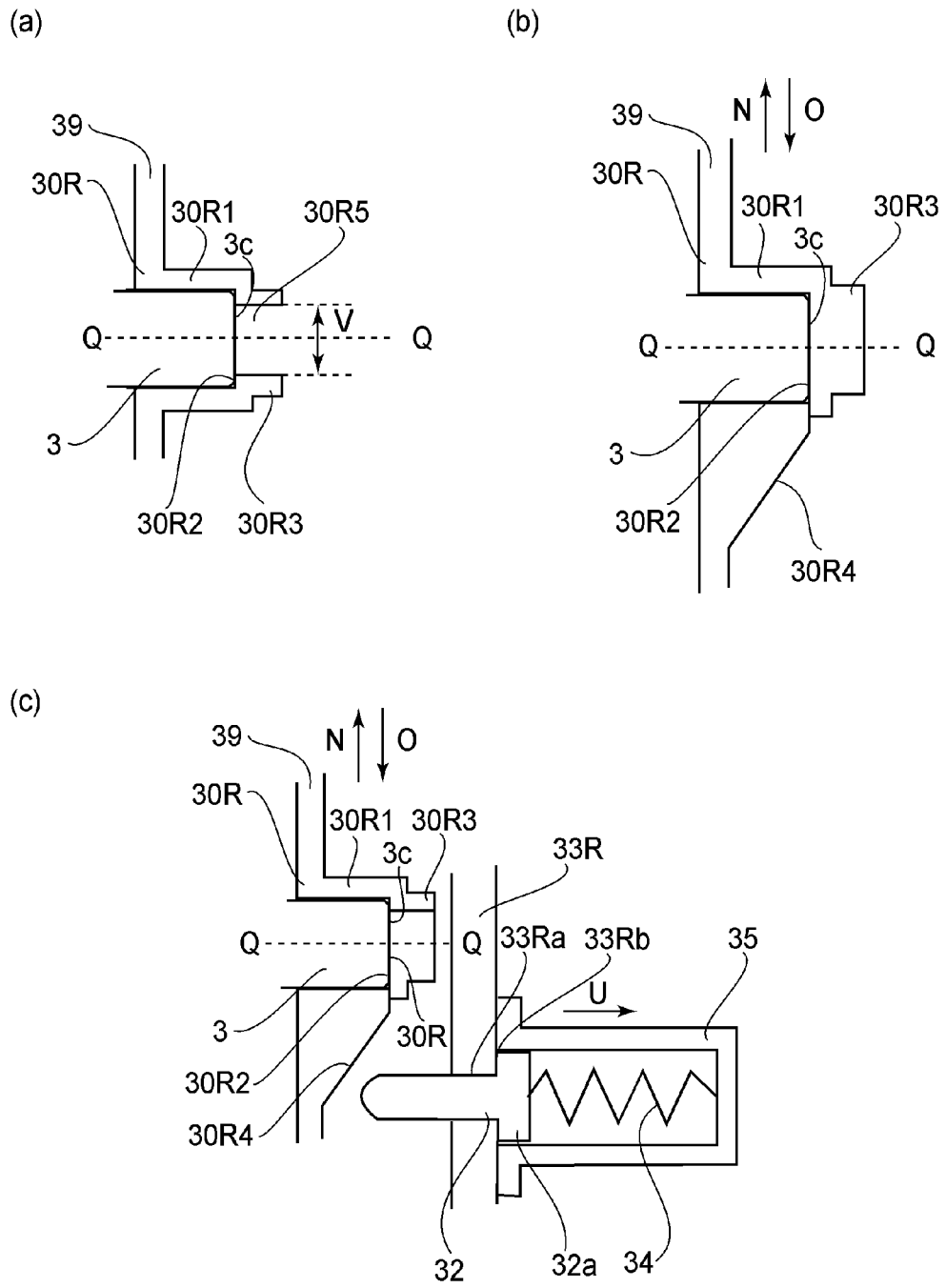
FIGS. 24(*a*), 24(*b*), and 24(*c*) are enlarged sectional views of the lengthwise end of the charge roller of the process cartridge, as seen from the direction from which the process cartridge is mounted.

FIG. 24(*b*) is an enlarged schematic sectional view of the essential portions of the process cartridge 39, as seen from the direction (direction indicated by arrow mark X in FIG. 23) perpendicular to the direction from which the process cartridge 39 is mounted, prior to the mounting of the process cartridge 39. The supporting member 30R of the process cartridge 39 has a guiding portion 30R4 for guiding the main assembly electrical contact 32 of the apparatus main assembly 38 to the end surface 3*c* of the charge roller 3 when the process cartridge 39 is mounted into the apparatus main assembly 38. The guiding portion 30R4 is provided on the downstream side of the through hole 30R6 in terms of the direction in which the process cartridge is mounted into the apparatus main assembly 38 (indicated by arrow mark O in FIG. 23). The guiding portion 30R4 is a slanted surface, the upstream end of which is lower than its downstream end.

Next, referring to FIG. 22(*b*), as the main assembly electrical contact 32 becomes connected to the end surface 3*c* of the charge roller 3, it compresses the spring 34 in the direction indicated by the arrow mark U by a distance t2. That is, before the main assembly electrical contact 32 comes into contact with the end surface 3*c* of the charge roller 3 when the process cartridge 39 is mounted, the main assembly electrical contact 32 and supporting portion 30R1 overlap with each other in terms of the cartridge mounting direction (they are located so that they interfere with each other).

Thus, in order to allow the main assembly electrical contact 32 to smoothly enter the through hole 30R6 through the passage 30R5, the supporting member 30R is provided with the guiding portion 30R4, which is on the downstream side of the supporting portion 30R1 of the supporting member 30R in terms of the cartridge mounting direction. Thus, while the process cartridge 39 is mounted into the apparatus main assembly 38, the main assembly electrical contact 32 comes into contact with the guiding portion 30R4. Then, as the process cartridge 39 is advanced further in the direction indicated by an arrow mark O in FIG. 23, the main assembly electrical contact 32 is guided by the guiding portion 30R4, being thereby made to gradually retract in the direction indicated by the arrow mark U in FIG. 24(*c*). Then, the main assembly electrical contact 32 enters the through hole 30R6 by way of the passage 30R5, being thereby guided to the end surface 3*c* of the charge roller 3, and comes into contact with the end surface 3*c*. Therefore, the process cartridge 39 is smoothly mountable in the apparatus main assembly 38, making it possible to reliably supply the charge roller 3 with voltage, without reducing the image forming apparatus in usability. The structure and function of this guiding portion 30R4 are the same as those of the guiding portion 19R4 in the first preferred embodiment.

As described above, in this embodiment, the image forming apparatus is structured so that the end surface of one of the lengthwise ends of the charge roller 3 in terms of the axial direction of the charge roller 3 makes direction contact with the main assembly electrical contact 32. The employment of this structural arrangement can reduce, in count and cost, the components involved in the electrical connection between the main assembly of an image forming apparatus and a process cartridge, and can simplify an image forming apparatus in structure, without interfering with the reliability with which voltage is supplied from the apparatus main assembly to the process cartridge.

Further, the supporting member 30R is provided with the protective portion 30R3 which extends from the main portion of the supporting member 30R in the abovementioned lengthwise direction of the charge roller 3, beyond the end surface 3*c* of the charge roller 3, to protect the end surface 3*c*. Thus, such a problem that a user touches the electrically conductive grease coated on the end surface 3*c* of the charge roller 3 is prevented. Further, the supporting member 30R is provided with the passage 30R5, which is on the downstream side, in terms of the direction in which the process cartridge 39 is mounted into the apparatus main assembly 38, to allow the main assembly electrical contact 32 of the apparatus main assembly 38 to pass. Therefore, the protective portion 30R3 is prevented from interfering with the main assembly electrical contact 32 when the process cartridge 39 is mounted into the apparatus main assembly 38.

Further, the supporting member 30R has the supporting portion 30R1, as an engaging portion, which engages with the positioning portion (unshown), with which the apparatus main assembly 38 is provided. Therefore, as the process cartridge 39 is mounted into the apparatus main assembly 38, the supporting portion 30R1 engages with the abovementioned positioning portion (unshown). As a result, the main assembly electrical contact 32 is precisely positioned on the axial line of the charge roller 3.

Further, the supporting member 30R has the guiding portion 30R4 which is on the downstream side of the through hole 30R6 in terms of the direction in which the process cartridge 39 is mounted into the apparatus main assembly 38, and which guides the main assembly electrical contact 32 to the end surface 3*c* (one of end surfaces) of the charge roller in terms of the axial direction, when the process cartridge 39 is mounted into the apparatus main assembly. Therefore, when the process cartridge 39 is mounted into the apparatus main assembly 38, the main assembly electrical contact 32 is guided to the end surface 3*c* of the charge roller 3 along the guiding portion 30R4. Therefore, the process cartridge 39 is smoothly mountable into the apparatus main assembly 38, making it possible to reliably supply the charge roller 3 with voltage, without reducing in usability the image forming apparatus and the development cartridge therefor.

[Miscellaneous Embodiments]

In the preceding preferred embodiments of the present invention, the process cartridge 39, which has the photosensitive drum 2 and charge roller 3, was independent from the development cartridge 5, which has the development roller 21. However, these embodiments are not intended to limit the present invention in terms of process cartridge type. For example, the present invention is also compatible with a process cartridge made up by integrating the process cartridge 39 and development cartridge 5. In the case of integrating the process cartridge 39 and development cartridge 5, they should be integrated so that the development roller supporting member and charge roller supporting member of the resulting process cartridge will be the same in structure, because such an integration can offer the same effects as those described above regarding the preceding embodiments, that is, it can further reduce in component count the resulting process cartridge, and therefore, can simplify in structure, and can reduce in cost, the resulting process cartridge.

Also in the second preferred embodiment, the process cartridge was removably mountable in the main assembly of the image forming apparatus, and had a photosensitive drum and a charge roller. However, the second embodiment is not intended to limit the application of the present invention to a process cartridge of the above described type. That is, the present invention is compatible with any process cartridge having at least an electrophotographic photosensitive member and one or more processing means for processing the photosensitive member. By structuring the main assembly of an electrophotographic image forming apparatus and a process cartridge therefor so that the roller (or rollers), which the process cartridge has, directly contacts the electrical contact (contacts), which the main assembly of the apparatus has, it is possible to reduce the image forming apparatus and process cartridge therefor in component count, simplify them in structure, and reduce them in cost.

Further, in the first preferred embodiment, the image forming apparatus used four development cartridges. However, the first embodiment is not intended to limit the present invention in terms of the development cartridge count. That is, the present invention is applicably to any electrophotographic image forming apparatus regardless of the development cartridge count. Further, the present invention is applicable to any electrophotographic image forming apparatus regardless of the process cartridge count.

Further, in the preceding preferred embodiments, the electrophotographic image forming apparatuses were printers. However, the preceding embodiments are not intended to limit the application of the present invention to a printer. That is, not only is the present invention applicable to a printer, but also, other image forming apparatuses, such as a facsimile apparatus. Further, the present invention is applicable to a multifunction apparatus, that is, an apparatus made up of a printer, a facsimile, etc., and capable of functioning as various image forming apparatuses.

The application of the present invention is not limited to an image forming apparatus, which has an intermediary transfer member, transfers in layers toner images, different in color, onto the intermediary transfer member, and transfers all at once the toner images on the intermediary transfer member, onto recording medium. The present invention is also applicable to an image forming apparatus, which has a recording medium bearing member, and sequentially transfers in layers, toner images, different in color, onto the recording medium on the recording medium bearing member.

That is, the application of the present invention to the cartridge, which is removably mountable in any of the above-mentioned electrophotographic image forming apparatuses can provide the same effects as those achieved by the image forming apparatuses in the preceding preferred embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 223043/2008 and 160763/2009 filed Sep. 1, 2008 and Jul. 7, 2009, respectively, which are hereby incorporated by reference.

What is claimed is:

1. A cartridge comprising:

a frame having an opening and an abutment portion;

a roller provided in said frame and including an electroconductive shaft, said roller being rotatable with said shaft, said shaft including an end surface facing in a longitudinal direction of the shaft, and said shaft having (i) a portion abutted by said abutment portion of said frame and (ii) an electroconductive portion exposed to outside of said cartridge through said opening of said frame; and an urging member for urging said shaft to said abutment portion, wherein said urging member includes a helical gear or a spring.

2. A cartridge according to claim 1, wherein said abutment portion defines a hole through which said electroconductive portion is exposed to outside of said cartridge.

3. A cartridge according to claim 1, wherein said abutment portion has a protecting portion projecting outwardly.

4. A cartridge according to claim 1, wherein said abutment portion has a ring-like shape.

5. A cartridge according to claim 1, wherein said roller is one of a charging roller for charging an electrophotographic photosensitive member, a developing roller for developing an electrostatic latent image formed on said electrophotographic photosensitive member, or a developer supplying roller for supplying developer to said developing roller.

6. A cartridge according to claim 1, further comprising:

an electrophotographic photosensitive member; and process means actable on said electrophotographic photosensitive member.

7. A cartridge comprising:

a roller including an electroconductive shaft, said roller being rotatable with said shaft;

a supporting member for rotatably supporting said shaft and provided with a hole portion for exposing a part of a surface of a longitudinal end of said shaft, wherein said part of said surface faces in a longitudinal direction of the shaft, and said supporting member includes a positioning portion for positioning said roller in the longitudinal direction by contacting another part of said surface, and wherein said another part of said surface faces in the longitudinal direction of the shaft.

8. A cartridge according to claim 7, wherein said supporting member includes a guide portion sloped so as to ascend toward said longitudinal end of said shaft.

9. A cartridge according to claim 7, wherein said roller is one of a charging roller for charging an electrophotographic photosensitive member, a developing roller for developing an electrostatic latent image formed on said electrophotographic photosensitive member, or a developer supplying roller for supplying the developer to said developing roller.

10. A cartridge according to claim 7, further comprising:

an electrophotographic photosensitive member; and process means actable on said electrophotographic photosensitive member.

11. A cartridge according to claim 7, further comprising a protecting portion surrounding said hole portion and projecting outwardly from said surface in the longitudinal direction to protect the part.

12. A cartridge to claim 7, further comprising a passing portion, that is adjacent to the part of the surface of said longitudinal end of said shaft, said passing portion being disposed inside of said protecting portion with respect to the longitudinal direction of said shaft.

13. A cartridge comprising:

a frame; and a roller provided in said frame and including an electroconductive shaft, said roller being rotatable with said shaft, said shaft having an electroconductive end surface exposed to outside of said frame, wherein a slope is provided on an outer surface of said frame and protruded toward an outside of said frame, with said slope ascending toward said electroconductive end surface of said shaft, wherein said shaft includes an end surface facing in a longitudinal direction of said shaft and having a portion abutted by an abutment portion of said frame, and wherein said electroconductive end surface is exposed to outside of said frame through an opening in said frame.

14. A cartridge according to claim 13, wherein said abutment portion defines a hole through which said electroconductive portion is exposed to outside of said frame.

15. A cartridge according to claim 13, wherein said abutment portion has a projection projecting outwardly.

16. A cartridge according to claim 15, wherein said abutment portion has a ring-like shape that is open at a position where said slope extends toward said shaft.

17. A cartridge according to claim 13, wherein said roller is one of a charging roller for charging an electrophotographic photosensitive member, a developing roller for developing an electrostatic latent image formed on said electrophotographic photosensitive member, or a developer supplying roller for supplying developer to said developing roller.

18. A cartridge according to claim 13, further comprising:

an electrophotographic photosensitive member; and process means actable on said electrophotographic photosensitive member.

19. A cartridge according to claim 13, further comprising an urging member for urging said shaft to said abutment portion.

20. A cartridge according to claim 19, wherein said urging member includes a helical gear.

21. A cartridge according to claim 19, wherein said urging member includes a spring.

* * * * *